US007001464B1

(12) United States Patent
Erdman et al.

(10) Patent No.: US 7,001,464 B1
(45) Date of Patent: Feb. 21, 2006

(54) SYSTEM AND PROCESS FOR GLAZING GLASS TO WINDOWS AND DOOR FRAMES

(75) Inventors: Rodney V. Erdman, Princeton, MN (US); Nicholas J. Dahmen, Princeton, MN (US); Paul A. Van Kempen, Onamia, MN (US)

(73) Assignee: Erdman Automation Corporation, Princeton, MN (US)

( * ) Notice: Subject to any disclaimer, the term of this patent is extended or adjusted under 35 U.S.C. 154(b) by 0 days.

(21) Appl. No.: 10/794,190

(22) Filed: Mar. 5, 2004

Related U.S. Application Data

(60) Provisional application No. 60/452,209, filed on Mar. 5, 2003, provisional application No. 60/534,609, filed on Jan. 6, 2004.

(51) Int. Cl.
*B05B 13/02* (2006.01)
*B05C 11/00* (2006.01)

(52) U.S. Cl. ..... 118/305; 118/680

(58) Field of Classification Search ..... 118/305, 118/679, 680, 686, 695, 500
See application file for complete search history.

(56) References Cited

U.S. PATENT DOCUMENTS

| | | | | |
|---|---|---|---|---|
| 3,019,136 | A * | 1/1962 | Auffenorde et al. | 427/110 |
| 3,876,489 | A | 4/1975 | Chenel | |
| 3,990,570 | A | 11/1976 | Mercier et al. | |
| 4,085,238 | A | 4/1978 | Chenel et al. | |
| 4,186,685 | A | 2/1980 | Chenel et al. | |
| 4,205,104 | A | 5/1980 | Chenel | |
| 4,546,723 | A | 10/1985 | Leopold et al. | |
| 4,564,410 | A | 1/1986 | Clitheros et al. | |
| 4,617,073 | A | 10/1986 | Scott | |
| 4,726,875 | A | 2/1988 | Lenhardt | |
| 4,964,362 | A * | 10/1990 | Dominguez | 118/315 |
| 5,009,933 | A * | 4/1991 | Matsuda et al. | 427/287 |
| 5,319,186 | A | 6/1994 | Lenhardt | |
| 5,332,080 | A | 7/1994 | Lenhardt et al. | |
| 5,348,585 | A * | 9/1994 | Weston | 118/305 |
| 5,350,469 | A | 9/1994 | Lenhardt et al. | |
| 5,765,722 | A * | 6/1998 | Beebe et al. | 222/1 |
| 6,234,355 | B1 | 5/2001 | Lenhardt | |
| 6,286,288 | B1 | 9/2001 | France | |
| 6,630,028 | B1 | 10/2003 | Briese et al. | |

OTHER PUBLICATIONS

Marketing Brochure, Machine Techniques Inc. (describing glass handling products such as cutting systems, vertical washers, caster tables, sealing tables, tilting grid tables, roller press carts, aculineal optimizers, weather strippers, wrappers, sash/frame conveyors, assemblers), 2003, can be located at www.mti-glass.com.

(Continued)

*Primary Examiner*—Chris Fiorilla
*Assistant Examiner*—Yewebdar Tadesse
(74) *Attorney, Agent, or Firm*—Patterson, Thuente, Skaar & Christensen, P.A.

(57) ABSTRACT

A glazing apparatus to glaze a window or door sash is described that includes a nozzle and a gear metering assembly. The metering assembly creates a flow of glazing material through the nozzle at a controlled rate such that the rate of flow of glazing material from the nozzle is proportional to a distance that the nozzle travels across the sash. The invention also allows the production of a finished window or door from precut glass and a pre-assembled sash at a single manufacturing station. The invention largely eliminates the effect of operator skill and experience on the quality of the finished product by evenly depositing sealant on the window frame as well as desiccant within a channel formed in the window frame.

14 Claims, 33 Drawing Sheets

OTHER PUBLICATIONS

Marketing Brochure, BILLCO Manufacturing (describing products and operating principles of glass handling equipment), pp. 8, date unknown.

Marketing Brochure, WEGOMA, Inc., (describing a glass bead fabrication center), 2000, can be located at www.wegomaincusa.com/NewProducts/new_products.htm.

Marketing Brochure, Thermoseal Group, *Sealed Unit Manufacturing Equipment*, pp. 13, can be located at www.thermosealgroup.com, date unknown.

Marketing Brochure, Carlson Systems Engineering, *Cabinet & Furniture Machines / Millwork Assembly Machines*, can be located at www.carlsonengineering.com, date unknown.

Marketing Brochure, A-TECH North American, Inc., *Machinery & Equipment for Windows & Doors*, 2002, can be located at www.a-technorthamerica.com.

Marketing Brochure, BESTEN Inc., *Product Listing and Videos*, 2001, can be found at www.besteninc.com.

* cited by examiner 10
14
28
12
24
18
26
16
38
24

10
28
22
30
14
36

10
40
34
18, 14
42
36
12
38
24
16
26
32
28
34
24

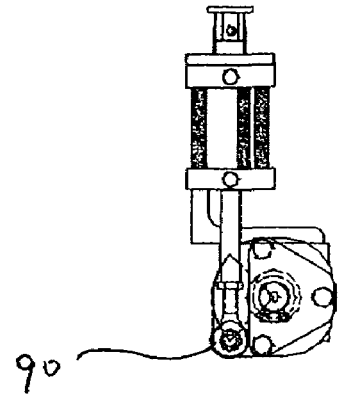
FIG 18
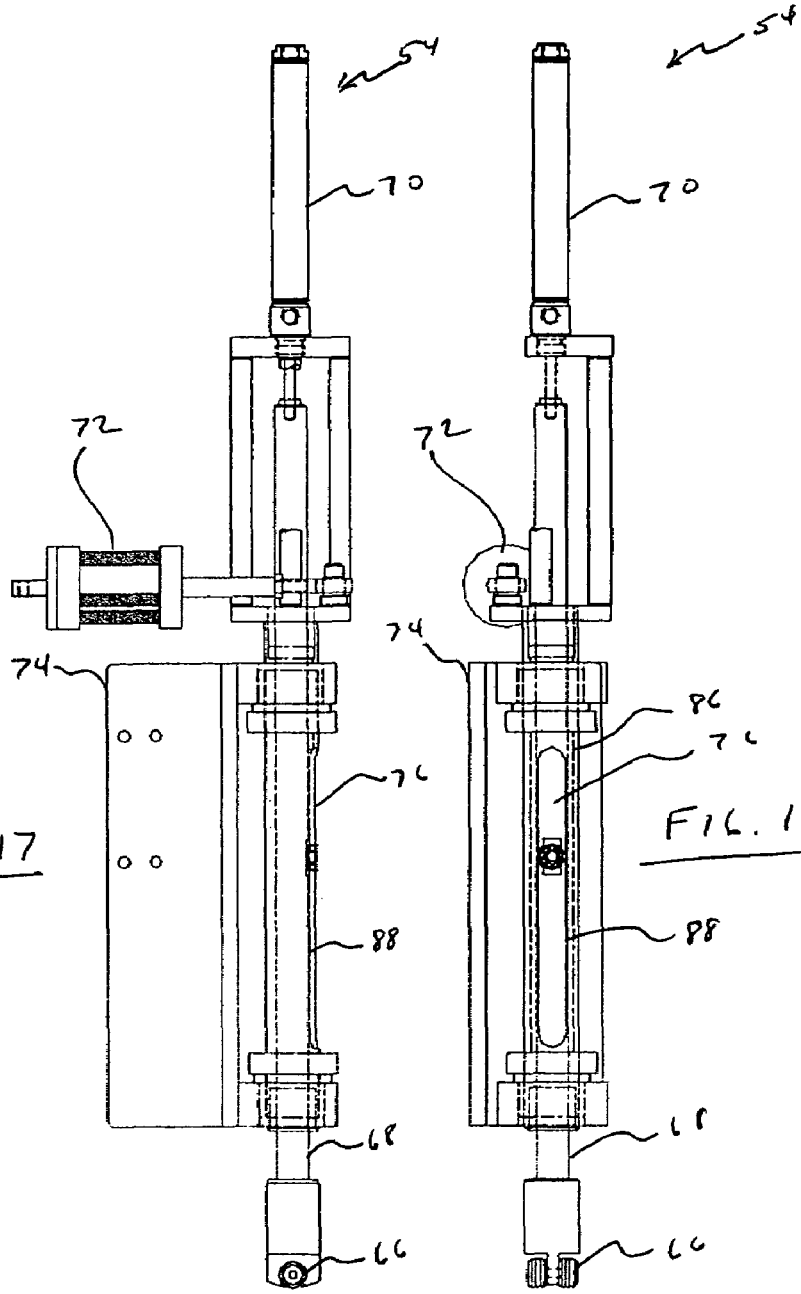
FIG.17
FIG. 16

1 REMOVE PAINT FOR BONDING.

661

SYSTEM AND PROCESS FOR GLAZING GLASS TO WINDOWS AND DOOR FRAMES

CLAIM TO PRIORITY

This application claims priority to U.S. Provisional Application Ser. Nos. 60/452,209 filed Mar. 5, 2003 entitled "System and Process for Glazing Glass to Windows and Door Frames," to 60/534,609 entitled "Multiposition Glazing Sealant Dispensing System" filed Jan. 6, 2004, the entire contents of which are incorporated herein by this reference.

RELATED APPLICATIONS

This application is related to U.S. Provisional Application Ser. Nos. 60/452,606 entitled "Quick Change Nozzle" filed Mar. 6, 2003, to 60/454,275 entitled "Gear Pump Case" filed Mar. 13, 2003, to Utility Application filed on Mar. 5, 2004, entitled "Viscous Fluid Metering Device With Quick Change Nozzle" having Ser. No. 10/681,495 filed on Oct. 7, 2003, entitled "Assembly of Insulated Glass Structures of an Integrated Sash," the entire contents of which are incorporated herein by this reference.

TECHNICAL FIELD

The invention relates to a system and a process for adhering glass sheets to a frame for the purpose of fabricating finished windows and doors.

BACKGROUND OF THE INVENTION

Insulated glass is heavily utilized in modern residential and commercial construction. In many areas of the country, building codes require the use of insulated glass windows as a mandatory energy conservation measure as window with a single pane of glass alone have very little insulating value.

Insulated glass generally includes two panes of glass separated by a space. The perimeters of the two panes of glass are sealed to one another to allow no movement of ambient air into the space between the two panes of glass. The space is filled with dehydrated air or with another gas. To avoid later failure and fogging of the interior surfaces of the panes of glass, insulated glass must be tightly and permanently sealed.

Traditionally, insulated glass windows have been constructed by assembling an insulated glass unit and later inserting it into a sash. An insulated glass (IG) unit is constructed by sealing two panes of glass to a spacer that fits between the two panes of glass all the way around the perimeters of both planes of glass. Once the insulated glass unit is assembled and sealed, it is then inserted into a sash or frame. A sash typically includes a rectangular frame constructed of wood, vinyl or metal. The sash generally has a rabbeted construction so that the insulated glass unit may be recessed into the sash. The insulated glass unit is then sealed to the sash using sealants or caulking compounds. The completed sash unit then may be used in a larger insulated window assembly.

If moisture or other undesirable materials are left in the space between the pane fogging or a dirty appearance will develop on the interior surfaces of the glass panes. It is highly desirable to avoid this outcome because only replacing the insulated glass can cure it. Therefore, desiccants are introduced into the space between the panes during the assembly process to absorb water vapor and any other gaseous or vaporous contaminants that might reduce the clarity of the insulated glass unit.

Recently, a new development in the insulated glass arts has arisen. A spacerless sash material has been developed that allows windowpanes to be sealed directly to the sash to create insulated glass sashes eliminating the requirement of a separate spacer between the two glass panes.

Most IG units are manufactured with automatic equipment that is capable of supporting two panes of glass and that have the adhesive or sealant deposited on the lateral inside surface of the glass that adjoin to the spacer frame. A desiccant material is deposited on the inside surface of the spacer frame and the two panes are pressed against the spacer frame to trap gas with the desiccant material in the gap formed by the two panes of glass. Another adhesive or sealant is usually deposited on the outside surface of the spacer frame and between the two panes of glass to further seal the IG unit together. The IG units are then used as components of the window or doorframe.

Current IG fabrication equipment is primarily focused on high volume IG unit fabrication and is not conducive to fabrication of custom designed windows or door frames having glass unit shape requirements that vary from the high volume stock. Glazing equipment that can be used on a smaller scale has the drawback of forming beads of sealant on a glass surface that is not consistent from lot to lot. The size of sealant bead is typically dependent on the operator's experience and speed. A more experienced operator can produce can produce more uniform and appropriately sized beads of sealant.

Conventionally, insulated glass sashes have been assembled by laying the sash on a flat surface, applying a sealant material to the sash or to the insulated glass unit and lowering the horizontally supported insulated glass into the sash. When using a spacerless sash material, insulated glass is applied to the spacerless sash from both sides. In the assembly of a spacerless sash, the glass pane is applied to a first side of the sash, then the sash is turned over and a second glass pane is applied to the second side of the insulated sash to complete the assembly.

There is a need in the window and door fabrication industry for glazing equipment and a process for reducing the cost and the number of process steps required to manufacture a finished door and window. Further, there is a need for glazing equipment that provides for consistent sealant bead sizes irrespective of operator speed and experience. Furthermore, the speed-limiting step in the construction of insulated sashes is often that of applying sealants and desiccants. Sealants and desiccants are applied as a vicious liquid, much in the manner that a caulking gun is used to apply caulk. It would be a great benefit to the art if the application of sealant and desiccant to insulated sashes could be done more quickly, thus allowing greater speed of throughput in the assembly process.

SUMMARY OF THE INVENTION

The glazing equipment and process of the various embodiments of the invention meet the aforementioned needs of the industry. The various embodiments of the invention also allow the production of a finished window or door from precut glass and a pre-assembled sash at a single manufacturing station. By evenly depositing sealant, desiccant materials and other window/sash coating materials, the factor of operator skill/experience level is virtually eliminated. The systems described herein are not limited in applying coatings of any type to any sash-type item.

The embodiments described herein provide a manually operated and automatic glazing systems wherein the dispensing of viscous liquid sealants and desiccants is controlled by state-of-the-art motion control elements that provide the intelligence to drive a sealant gear metering device and valve to dispense sealant at a rate that is a function of the distance traveled as the operator moves the sealant head. In one embodiment, a hand glazing machine control system allows even a novice operator to reliably and consistently apply a properly positioned and sized bead of sealant to the door and window glass at speeds up to, but not limited to, thirty inches per second. Bead sizes are as small as 0.060" and up to 0.50" can be applied.

In another embodiment of the invention, allowing for the automated simultaneous application of insulated glass sealant and desiccant to a spacerless sash solves many of the above problems. The present invention includes the simultaneous application of all necessary sealant to a spacerless sash as well as the simultaneous application of desiccant to the spacerless sash. The invention further includes the automated application of glass panes to both sides of a spacerless sash. This application of glass panes may be accomplished with the spacerless sash in any orientation but there are certain advantages to accomplishing the application with the sash in a generally vertical orientation.

Problems associated with both removing dust and particulate matter from spacerless sash material and with collecting the dust and particulate matter (to avoid re-deposition elsewhere) are addressed in a related embodiment of the glazing system. In this example embodiment, an ionized air gun with a surrounding vacuum dust collector and a separate workstation with a dust hood operate in close proximity with a glazing apparatus. The ionized air gun provides streams of compressed ionized air to both dislodge particulate matter from the spacerless sash material by air movement and to neutralize the static charge often present. A concentric annular vacuum dust collector that isolates and draws away dislodged particulate matter from the window or doorframe surrounds the ionized air gun. The dust hood collects any particulate manner that may escape from the concentric vacuum dust collector.

The ionized air gun/vacuum dust collector combination is constructed so that the ionized air gun discharges its flow of ionized air through a central port surrounded by a cylindrical ring of brush bristles. The vacuum dust collector surrounds this cylindrical ring of brush bristles in an annular fashion. The vacuum dust collector then has a second cylindrical ring of brush bristles surrounding it. The gun/vacuum arrangement both largely contains dislodged particulate matter in the close vicinity of the ionized air gun vacuum dust collector tool and provides a brush bristle tool properly suited to dislodge particulate matter that may require mechanical loosening.

The ionized air gun vacuum dust collector tool is preferably utilized at a workstation that includes a dust hood that constantly draws air from the work station and into a dust collection system with appropriate filtering. In this way, any dust or particulate matter that escapes from the ionized air gun vacuum dust collector tool is collected by the dust hood and removed from the area.

BRIEF DESCRIPTION OF THE DRAWINGS

The invention may be more completely understood in consideration of the following detailed description of various embodiments of the invention in connection with the accompanying drawings, in which:

FIG. 16 is a detailed plan view of a roller press as utilized in the invention;

FIG. 17 is a side plan view of the roller press of FIG. 16;

FIG. 18 is a top plan view of the roller press of FIGS. 16 and 17;

Figure 1:
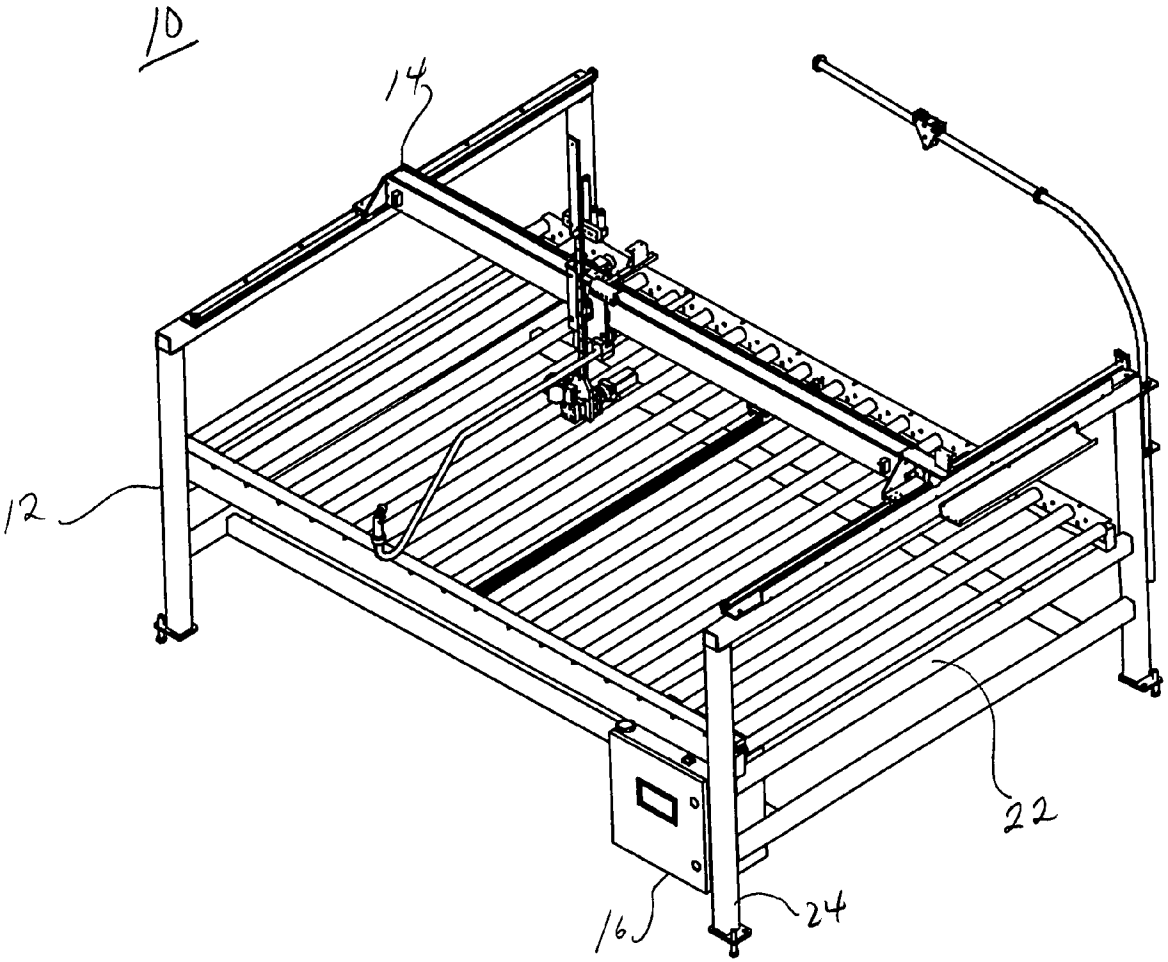
FIG. 1 is a perspective view of a manual assist glazer in accordance with the invention.
Figure 2:
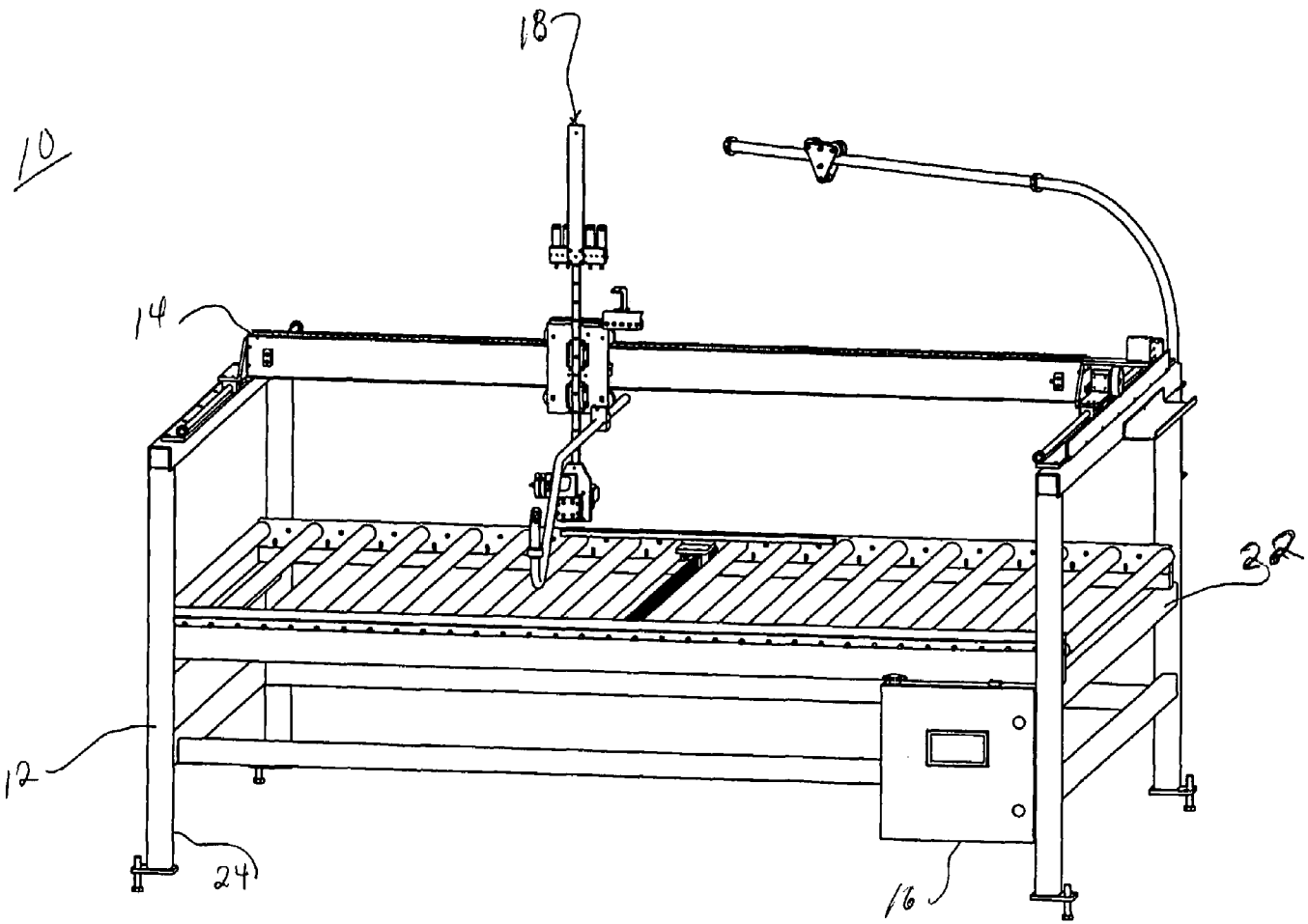
FIG. 2 is a perspective view of the manual assist glazer of FIG. 1 with the roll-in rollers raised.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

The invention includes a method and an apparatus for depositing a desiccant material and a sealant as part of a window or door fabrication process. The invention reduces the cost of the final product and the scrap generated in the process while reducing fabrication time involved in manufacturing doors and windows. While the invention is not necessarily limited to such an application, the invention will be better appreciated using a discussion of example embodiments in such a specific context.

Referring to FIGS. 1, 6, 7, 8, 11, 12 and 13 glazing unit 10 generally includes table 12, gantry 14, control module 16, sealant applicator 18, and optionally desiccant applicator 20. Table 12 generally includes table base 22 and legs 24. Table 12 supports gantry 14 and a cabinet 26 for control module 16. Table base 22 is a generally open structure whose top 28 is formed of multiple supports 30. Supports 30 are located generally parallel to one another and separated by spaces. Table base 22 also includes and supports clamping sweep 32. Clamping sweep 32 may be manually or automatically operated. Clamping sweep 32 serves to secure work pieces to table base 22.

Table base 22 also supports gantry 14. Gantry 14 generally includes support tracks 34, which are supported at each end of table 12, and girder 36. Girder 36 is movably supported at each end on support tracks 34. Girder 36 is supported by wheels (not shown) so that it may travel freely along the horizontal length of support tracks 34 along an X-axis. Girder 36 also may movably support sealant applicator 18 and desiccant applicator 20. Sealant applicator 18 and desiccant applicator 20 are movably supported upon girder 36 and can travel from one end of girder 36 to the other along a Y-axis.

Control module 16 includes programmable logic controller (PLC) 38, girder encoder 40, sealant encoder 42, desiccant encoder 44 and drive system 46. Girder encoder 40 measures and meters the movement of girder 36 relative to support tracks 34. Sealant encoder 42 measures and meters the movement of sealant applicator unit 18 relative to girder 36. Desiccant encoder 44 measures and meters the movement of desiccant applicator unit 20 relative to girder 36. Girder encoder 40, sealant encoder 42 and desiccant encoder 44 all provide input to programmable logic controller 38. Inputs include the direction and distance that girder encoder 40, sealant encoder 42 and desiccant encoder 44 move during operation of glazing unit 10. Sealant applicator unit 18 travels on gantry 14 and generally includes sealant carriage 46, sealant slider 48, sealant pump 50 and nozzle 52. Sealant carriage 46 travels back and forth on girder 36 preferably on rollers 56. Sealant slider 48 is slideably connected to sealant carriage 46 and carries sealant pump 50 and nozzle 52 with it as it moves in a vertical Z-axis direction.

Optionally, sealant carriage 46 may also include roller press 54. Roller press 54 is also slideably connected to sealant carriage 46 and is adapted to apply downward pressure to objects beneath sealant carriage 46.

Desiccant applicator unit 20 includes desiccant carriage 58, desiccant slider 60, desiccant pump 62 and nozzle 64. Similar to sealant carriage 46, desiccant carriage 58 travels along girder 36 on rollers 66. Desiccant slider 60 carries desiccant pump 62 and nozzle 64 in a sliding vertical traveling path relative to desiccant carriage 58.

In forming a spacerless window sash (or door frame), the window is positioned against the side and end stops on the conveyor bed of the glazing apparatus or unit 10. Utilizing a series of state-of-the-art motion control elements, the machine operator can consistently apply a properly positioned bead of sealant to the frame at speeds up to 30"/sec. Once the sealant bead has been laid in the rabbet (channel or groove within the window or door frame where sealant is to be placed), roller ball support rods raise to the level of the glass roll-in rollers. The operator can then manually set the glass into the positioning area by gently gliding the glass over the glass roll-in rollers. Utilizing the roller ball support rods, the operator will then glide the glass over the table to rest against the positioning stops, after which the rods lower the glass into the frame. Once the glass has been set in place, the operator can then insert the setting blocks as required. At this time, another bead of sealant may be applied to the top of the glass, if required. The complete product can then be manually or automatically conveyed off the table and onto the next workstation.

Referring again to FIG. 11, a two-arm manual assist glazing apparatus can be made from the embodiment illustrated therein. The two-arm manual assist glazer comprises a frame with a control module mounted thereon, a table base, an upper frame for supporting overhead gantries, a clamping sweep for securing the window or door to frame during assembly and an overhead gantry arrangement that moves horizontally back and forth across frame in a Y-direction. The gantry supports two manually operated glazing devices over the window or door being assembled that move horizontally back and forth across the gantry in an X-direction. Three encoders are coupled to gantry and each manual glazer, respectively, and to the PLC (programmable logic controller) input of the control module to measure and meter the movement of the gantry and the glazers. Knowing the speed and direction of the movement of each of the glazers arms by the operator helps the control module to determine how best to deposit the sealant evenly onto the sealing frame (door or window). The feedback program related to sealant deposition as a function of glazer speed and direction.

Figure 7A:
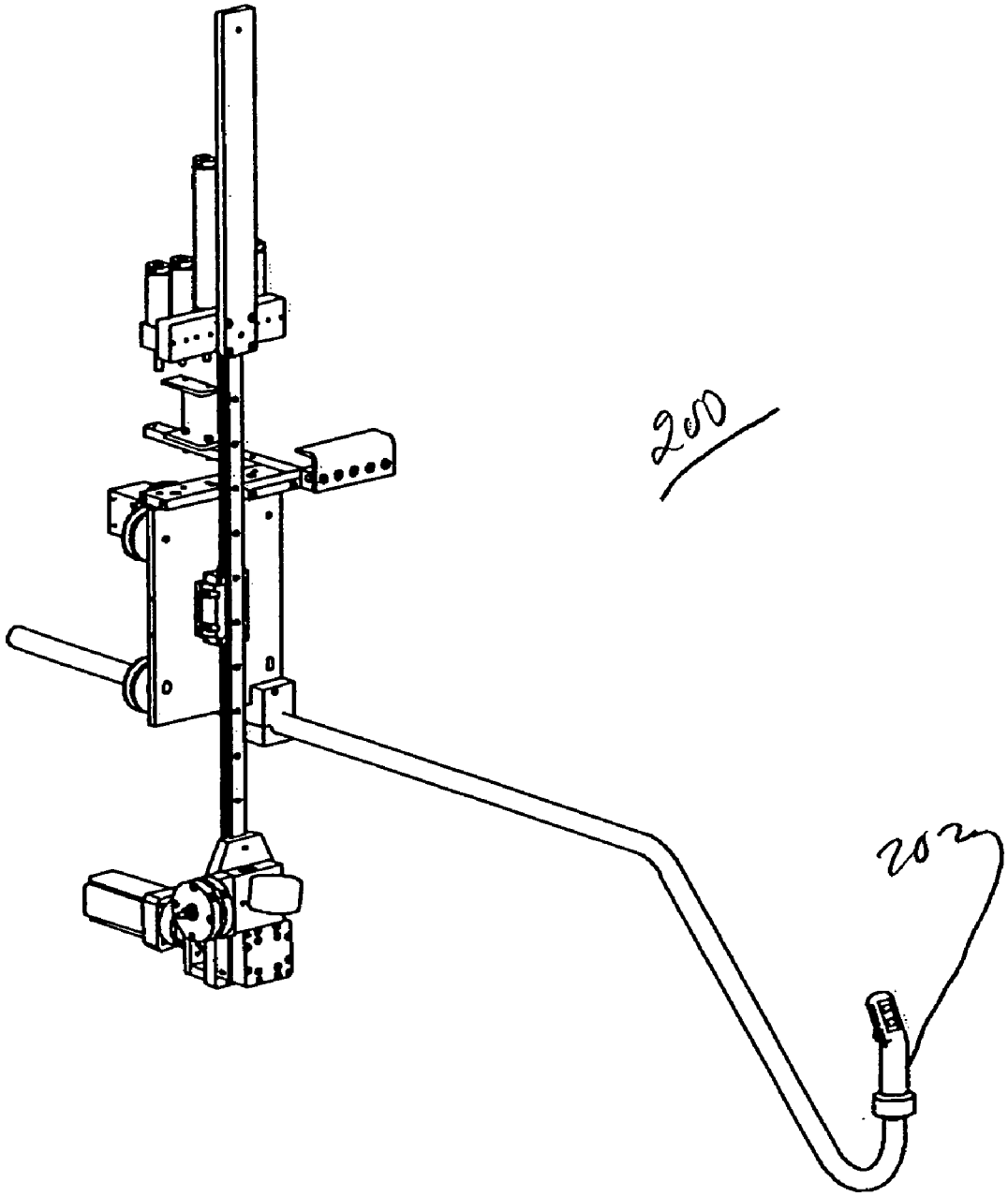
FIG. 7A is a perspective view of a hand control arm of a manual assist glazer.

In this example embodiment, the glazer arm is moved into its various positions via a hand control arm (such as, for example hand control arm 200 of FIG. 7A) that includes a hand controller (such as hand controller 202 of FIG. 7A), which controls the Z-axis movement of a sealant applicator (which includes a nozzle) that is coupled to a sealant meter or gear metering device. A high flow valve and gear body assembly that is coupled to the sealant meter and applicator is instrumental as well in depositing an even bead of sealant around the window or doorframe. The hand controller also controls the z-axis movement of a roller press that is either a separate part or can be fitted over the sealant applicator ands also controls the rotational movement of the sealant applicator and the roller press.

In a similar fashion, the second hand control arm moves the second glazer arm into various positions via a hand control arm that includes a second hand controller (not shown) that controls the z-axis movement of a desiccant sealant applicator (which includes a nozzle) that is coupled to a desiccant meter. The hand controller can also control the rotational movement of the desiccant applicator such that desiccant material can be easily deposited in 90° degree corners of the window or doorframe being manufactured.

The control module of this embodiment is programmed to control sealant and desiccant deposition and roller press pressure irrespective of the operator's speed through the various encoders in the glazing apparatus. For example, the control module calculates the velocity vectors of the glazer arms using two encoders and a programmable logic controller (PLC) having a square root function. The two selected encoders monitor a change in position of the glazer arm. The current position of the glazer arm is recorded in the programmable controller. During each program scan the current position of the glazer arm is compared to the previous glazer arm position recorded during the previous scan. The difference in the position or locations is converted to a velocity vector.

In related embodiment, the scan time of the programmable controller is measured and is used as a scale factor for the velocity vector. In another embodiment, adjusting the flow rate of more than one positive displacement pump is performed by combining the method of converting positional changes in encoders on the glazer arm into velocity vectors and using the scan time of the PLC as a scale factor for the velocity vector. Included herewith is Appendix A (32 pages) of code for the operations of the control module, which is incorporate herein by reference.

Referring to FIGS. 16–18, roller press 54 generally includes pressure rod 68, pressure actuator 70, rotation actuator 72 and support 74. Pressure rod 68 is slidingly supported within support 74. Pressure rod 68 includes rod 76, roller support 78, rollers 80 and alignment bearing 82. Support 74 generally includes bracket 84 and slotted cylinder 86. Rod 76 is a close fitting sliding fit within slotted cylinder 86. Alignment bearing 82 travels within slot 88 of slotted cylinder 86. Slotted cylinder 86 is held within bracket 84 so that slotted cylinder 86 may rotate about the axis of rod 76. Desirably rod 76 is supported within slotted cylinder 86 by a pair of bronze bushings. Pressure actuator 70 is desirably a pneumatic cylinder. Air pressure supplied to the pneumatic cylinder may be regulated to apply a desired amount of pressure to the roller press 54. Rollers 80 desirably include two independently rotating wheels that can pivot on roller support 78. Rollers 80 are desirably covered "O-rings" for a soft pliant and easy to replace covering since the edges of glass will have a tendency to cut and damage the roller material.

Rotation actuator 72 is operably connected to slotted cylinder 86 desirably by a bellcrank 90. As rotation actuator 72 extends and retracts, bellcrank 90 converts the extension and retraction motion into a rotational motion that may be indexed to orient roller support 78 and rollers 80 to align correctly to roll on the glass perimeter to seat the glass into the adhesive.

Figure 14:
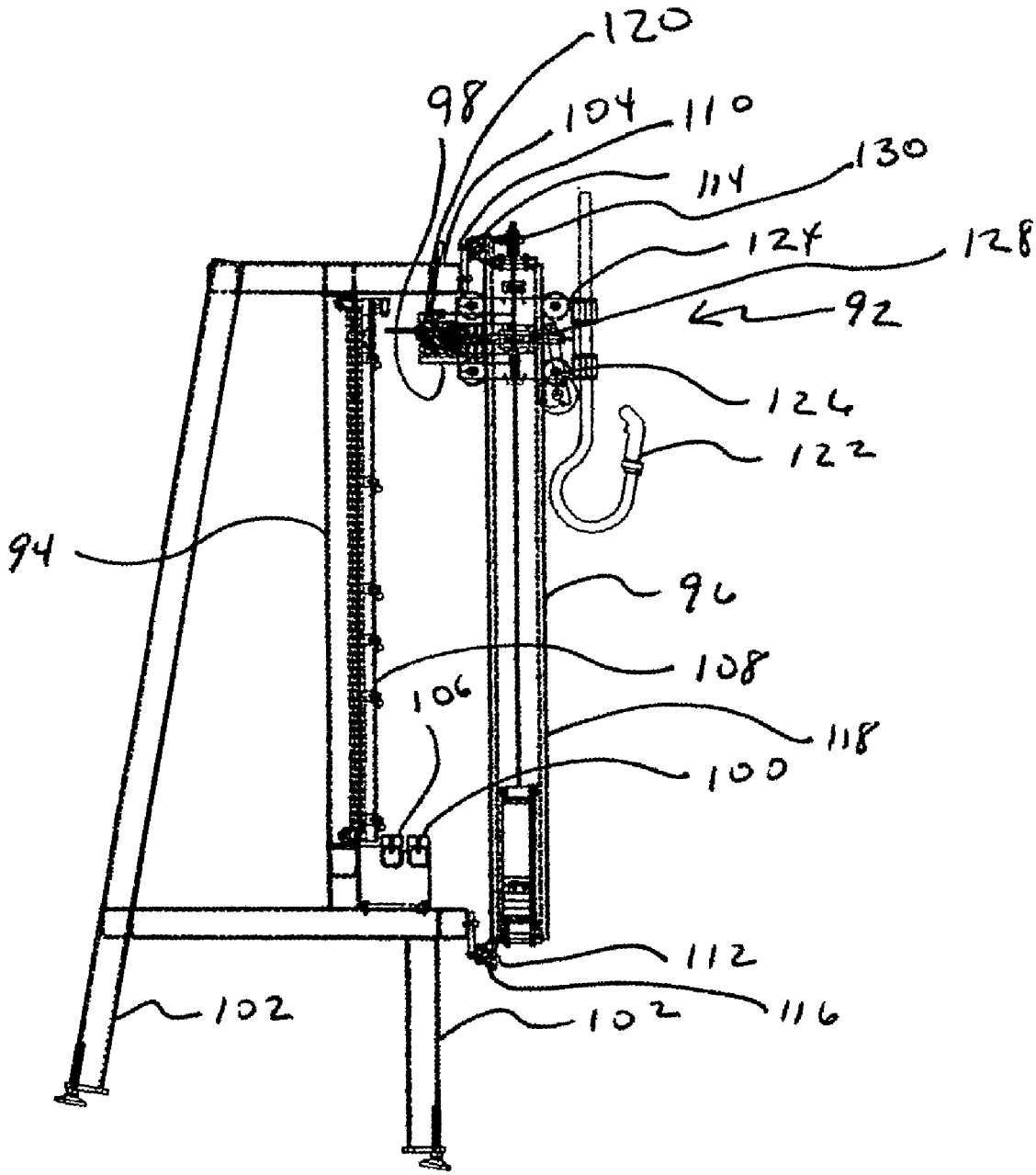
FIGS. 14 and 14A are side plan views of two embodiments of a manual assist vertical glazer in accordance with the invention.
Figure 15B:
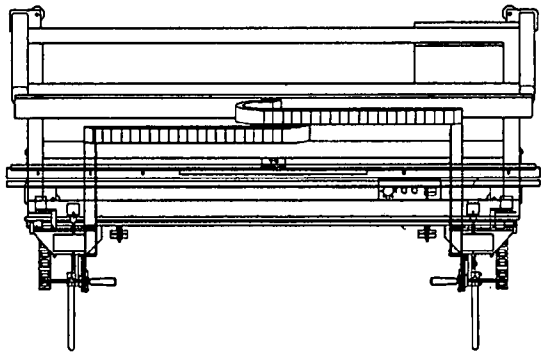
FIGS. 15, 15A and 15B are a front plan views of two embodiments of the vertical manual assist glazer depicted in FIGS. 14 and 14A.
Figure 15A:
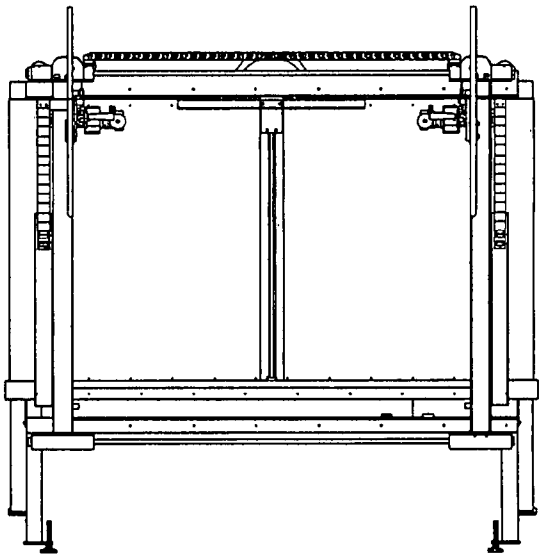
Figure 15:
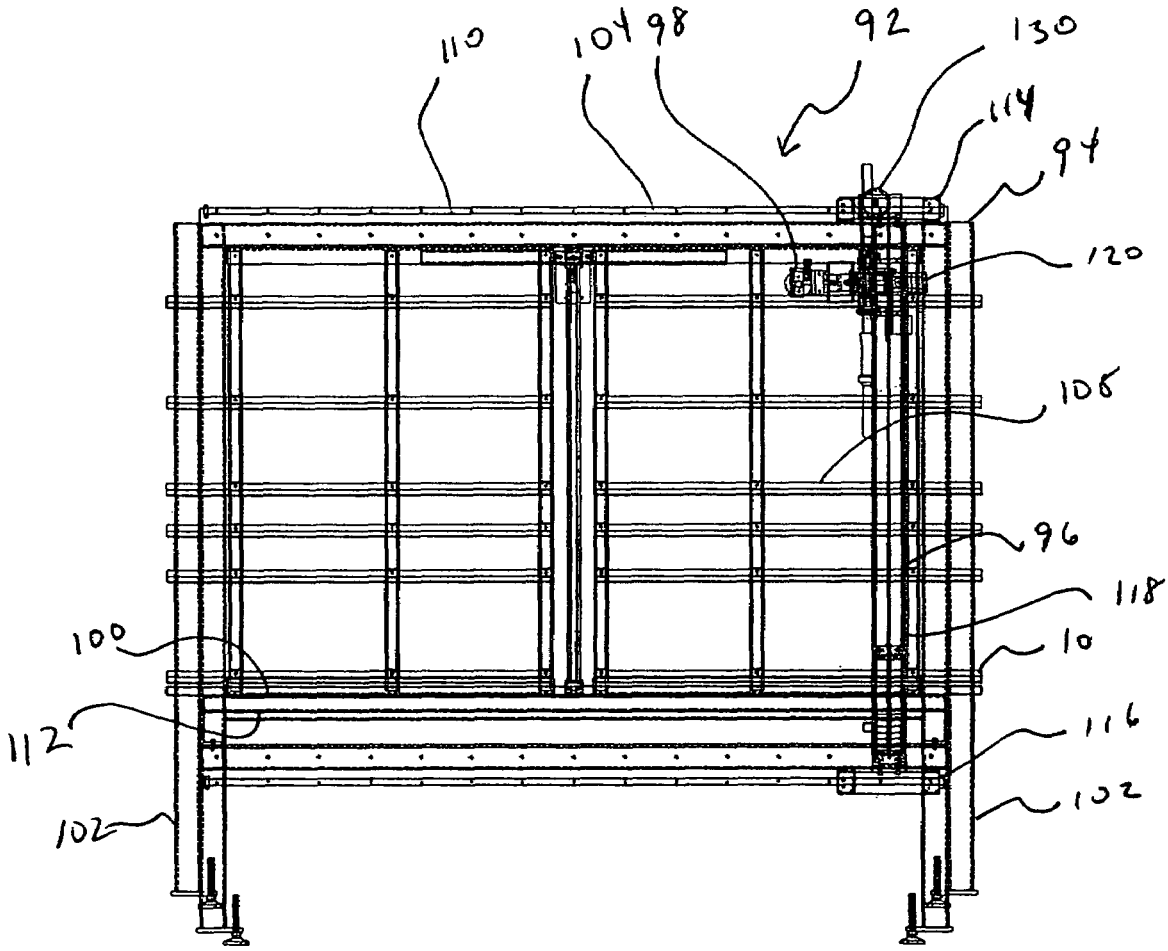

FIGS. 14–15 depict a vertical glazer rack 92 in accordance with the invention. Vertical glazer rack 92 generally includes support frame 94, traveler 96 and sealant dispenser 98. Support frame 94 generally includes sash support shelf 100, legs 102 and traveler support 104. Support frame 104 may be constructed of any robust material. For example, support frame 94, may be constructed from welded steel angles or box channel. Sash support shelf 100 includes shelf 106 and back 108. Conveniently, shelf 106 and back 108 may be tilted at an acute angle from the vertical in order to allow a sash to be held conveniently in place by gravity. Legs 102 provide a stable base for support frame 94.

Traveler support 104 supports traveler 96, which in turn supports sealant dispenser 98. One skilled in the art could envision many ways to support sealant dispenser 98 so that it can be moved in an x-axis and a y-axis. For example, a robotic arm could be utilized. It is envisioned that the invention includes any of these techniques. As depicted in FIGS. 14–15, traveler support 104 includes upper track 110 and lower track 112. Upper track 110 and lower track 112 are adapted to support traveler 96 in a slidingly movable fashion.

Traveler 96 generally includes upper roller 114, lower roller 116 and beam 118. Upper roller 114 slidingly engages upper track 110. Lower roller 116 slidingly engages lower track 112. Beam 118 interconnects upper roller 114 and lower roller 116. Thus, as a whole, traveler 96 can move from side to side along upper track 110 and lower track 112.

Beam 118 is adapted to support sealant dispenser 98. Sealant dispenser 98 is structured to travel vertically up and down beam 118 in a counterbalanced fashion. A counterweight, springs, gas supports or any other approach known to those skilled in the art can accomplish counterbalancing of sealant dispenser 98. As depicted in FIGS. 14–15, sealant dispenser 98 includes dispenser head 120, control handle 122 and rolling support 124.

Control handle 122 is operably connected to dispenser head 120 and rolling support 124. Control handle 122 provides a convenient grip for an operator to operate dispenser head 120. In a manually operated embodiment of the invention, control handle 122 provides a location for an operator to apply force to move dispenser head 120 in order to apply sealant to a sash.

Rolling support 124 travels vertically up and down beam 128 in a smooth fashion. Desirably, rolling support 124 includes wheels 126 to provide for a smooth motion. In addition, rolling support 124 includes vertical encoder 128. Vertical encoder 128 measures the motion of rolling support 124 relative to beam 118. Traveler 96 includes horizontal encoder 130. Horizontal encoder 130 serves to measure the motion of traveler 96 relative to traveler support 104.

Figure 14A:
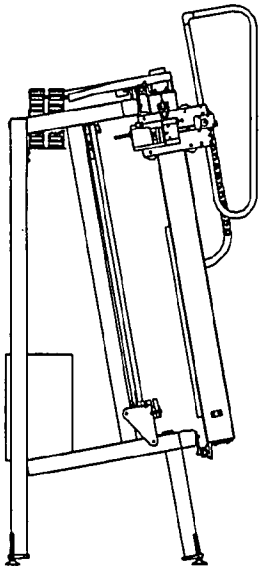

In a related embodiment of the vertical glazing system described above, illustrated by FIGS. 14A, 15A and 15B, a unique machine controlled, multi-headed sealant and desiccant dispensing apparatus is provided. The advantages to this example embodiment include that at least two dispense heads apply beads of sealant to opposed sides of the spacerless sash simultaneously while at least a third dispensing head dispenses a bead of desiccant compound through a sideward dispensing nozzle to the inside of the spacerless sash at the same time the sealant is applied. A further benefit of the present invention is that it allows for application of sealants desiccant and glazing materials in any orientation including an orientation with the sash in a vertical position. This allows for faster, easier assembly of insulated glass windows and can reduce the time required to assemble an insulated glass sash to as little as one-third the time required to accomplish the task by conventional means.

As with the previous embodiment, the traveler generally includes upper roller, lower roller and beam. Upper roller slidingly engages the upper track. Lower roller slidingly engages lower track while the beam interconnects the upper roller and lower rollers. Thus, as a whole, the traveler can move from side to side along upper track and lower track. The dispenser head may include a dispenser as previously described in this application or a two single head dispenser. Control handle is operably connected to dispenser head and rolling support. Control handle provides a convenient grip for an operator to operate dispenser head. In a manually operated embodiment of the invention, control handle provides a location for an operator to apply force to move dispenser head in order to apply sealant to a sash. Rolling support travels vertically up and down beam in a smooth fashion. Desirably, the rolling support includes wheels to provide for a smooth motion. In addition, the rolling support includes vertical encoder. The vertical encoder measures the motion of rolling support relative to the beam. Te traveler includes a horizontal encoder that serves to measure the motion of traveler relative to traveler support.

In operation, an unglazed sash is placed on sash support shelf. An operator then grasps the control handle and moves the dispenser head proximate to the portion of the sash to which it is desired to apply sealant. As the dispenser head is moved, the vertical and horizontal encoders track and measure the motion of the dispenser head and the traveler relative to the sash. Based upon the direction and distance traveled, the dispensing of sealant is metered and controlled in order that a uniform and appropriately sized bead of sealant is applied to the sash as desired.

Figure 3:
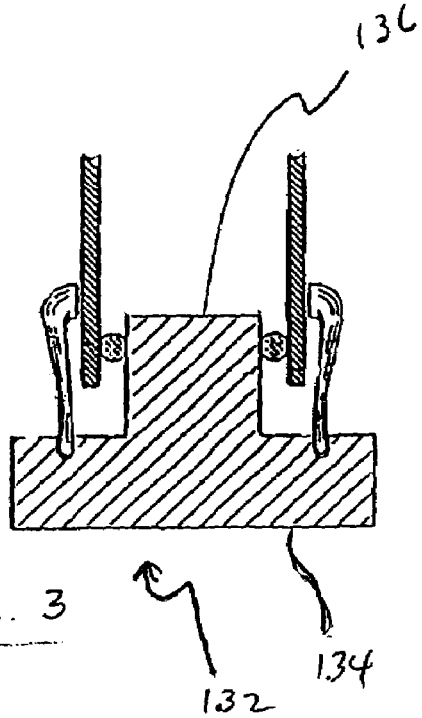
FIG. 3 is a cross sectional view of spacerless sash frame.
Figure 4:
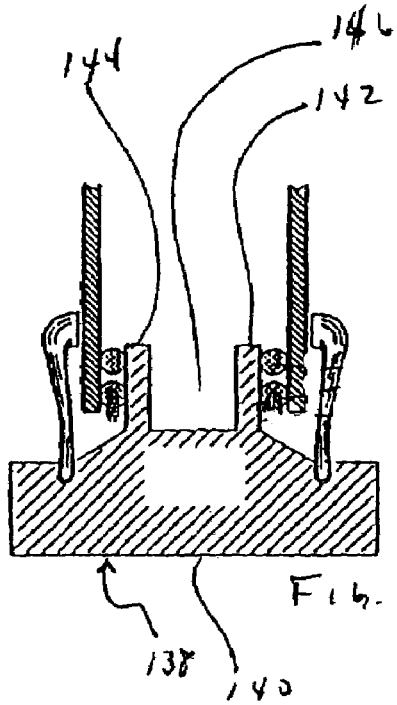
FIG. 4 is another cross sectional view of spacerless sash frame, including a desiccant space.
Figure 5:
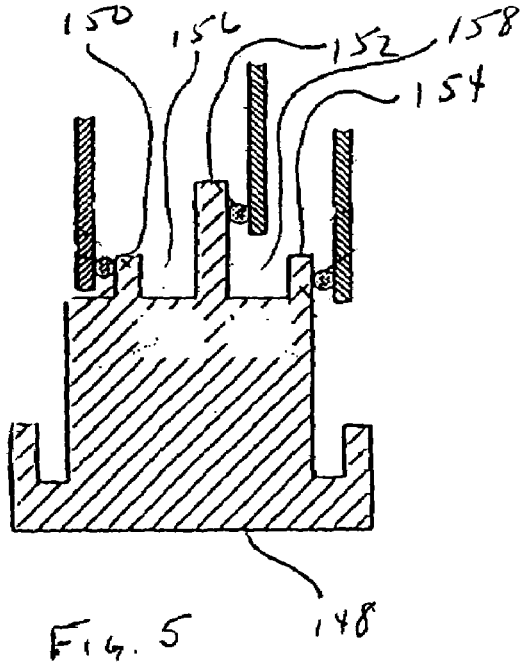
FIG. 5 is a cross sectional view of spacerless sash frame adapted for triple glazing.
Figures 6, 7, 8:
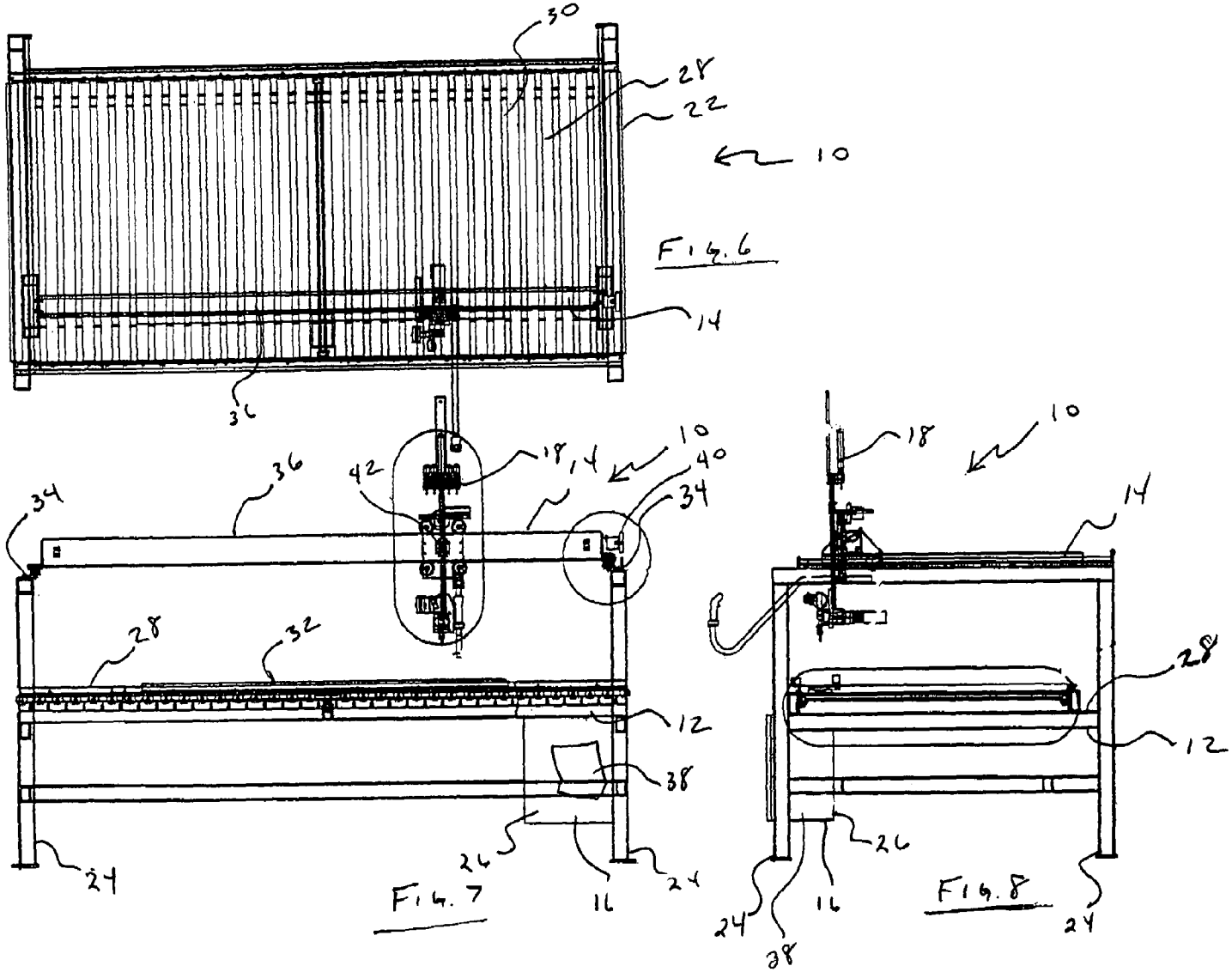
FIG. 6 is a top plan view of a manual assist glazer.
FIG. 7 is a front plan view of the manual assist glazer.
FIG. 8 is a side plan view of the manual assist glazer.

Referring now to FIGS. 3, 4 and 5, exemplary cross-sections of a spacerless window sashes are shown. As depicted in FIG. 3, spacerless window sash 132 generally includes a body 134 and pane support flange 136. As depicted in FIG. 4, spacerless window sash 138 generally includes a body 140 and two pane support flanges 142 and 144. Exemplary spacerless window sash 138 depicted in FIG. 4 also includes a desiccant space 146 defined between support flanges 142 and 144.

Referring to FIG. 5, a cross-sectional view of another spacerless sash is shown. This spacerless sash is adapted to support the use of triple glazed insulated glass, that is, insulated glass having three panes of glass with two intervening air spaces. This sash includes body 148, first flange 150, second flange 152, third flange 154, first desiccant space 156 and second desiccant space 158.

Figure 19:
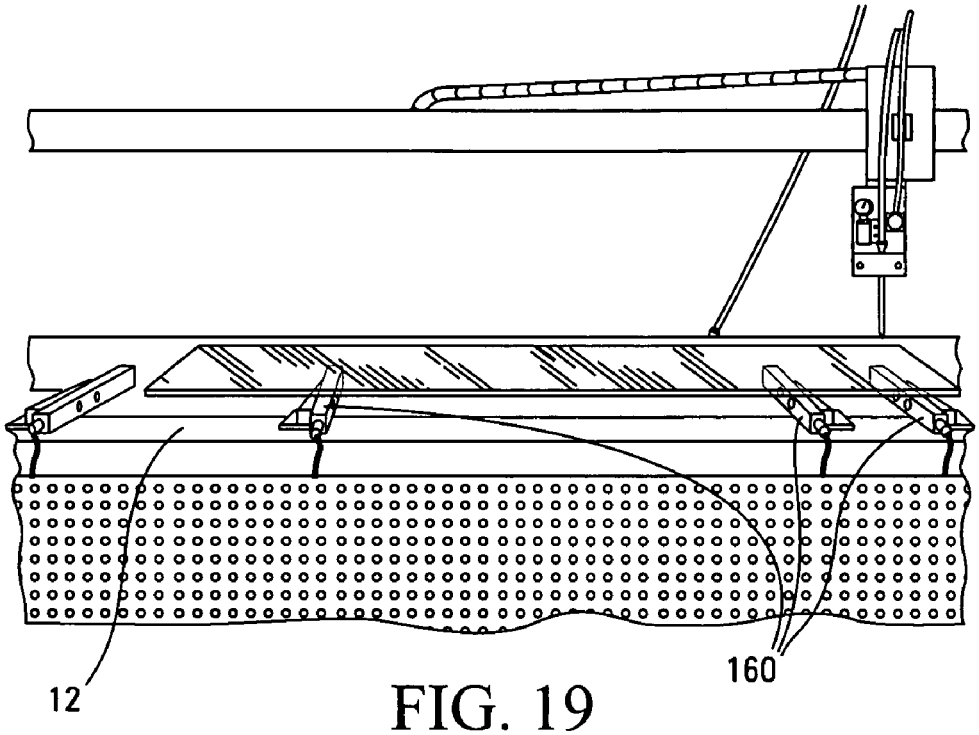
FIG. 19 is a perspective view of a glass lay in table with the roll-in rollers raised supporting a pane of glass.
Figure 20:
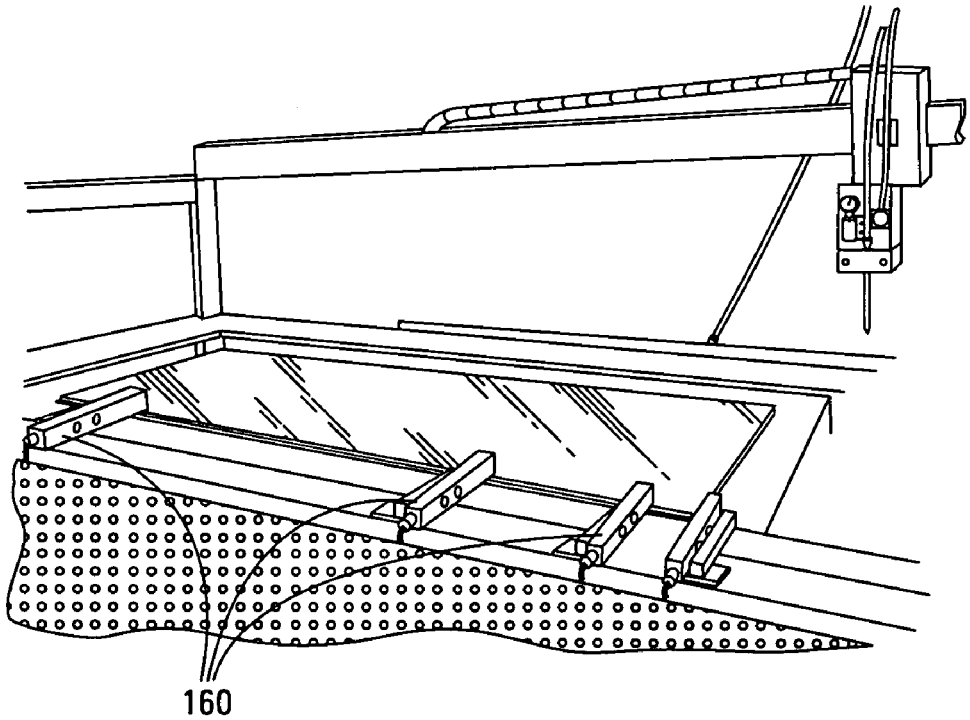
FIG. 20 is a perspective view of a glass lay in table with the roll-in rollers lowered.
Figure 22:
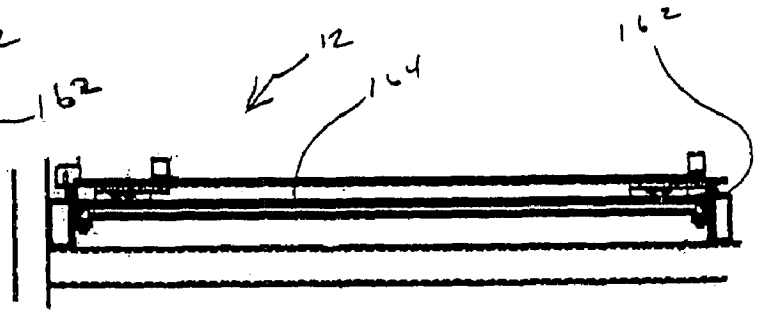
FIG. 22 is a side plan view of a table as utilized in the invention.
Figure 21:
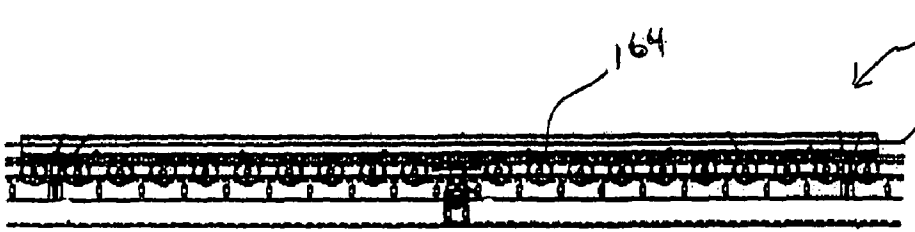
FIG. 21 is a front plan view of a table as utilized in the invention.

Referring now to FIG. 19, table 12 may include roll-in rollers 160. FIG. 19 depicts roll-in rollers 160 in the raised positioned supporting a glass pane. FIG. 20 depicts roll-in rollers 160 in a lowered positioned showing glass pane lowered into a sash. FIG. 21 is a front plan view of table 12. Table 12 includes frame 162 and rollers 164. As depicted in FIGS. 21 and 22, rollers 164 support a sash that can be rolled into position for application of glass panes.

Figure 10:
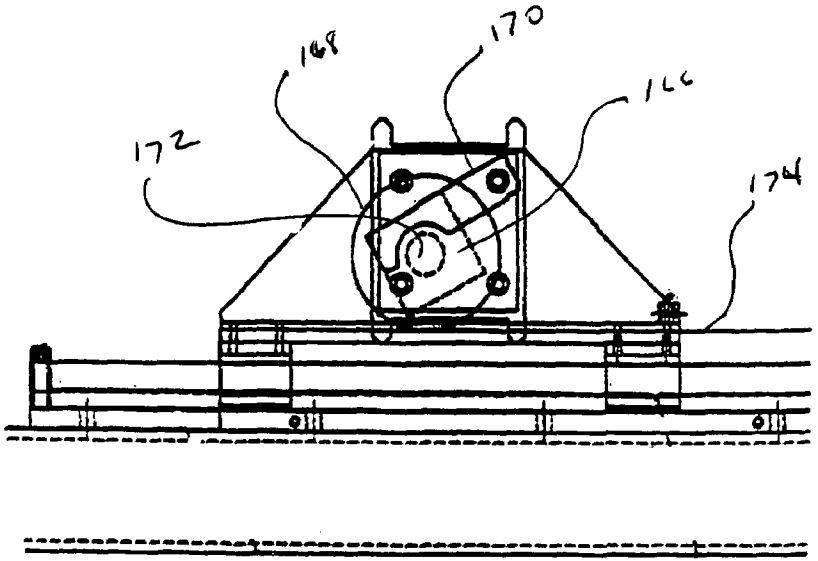
FIG. 10 is a side plan view of the encoder of FIG. 9.
Figure 9:
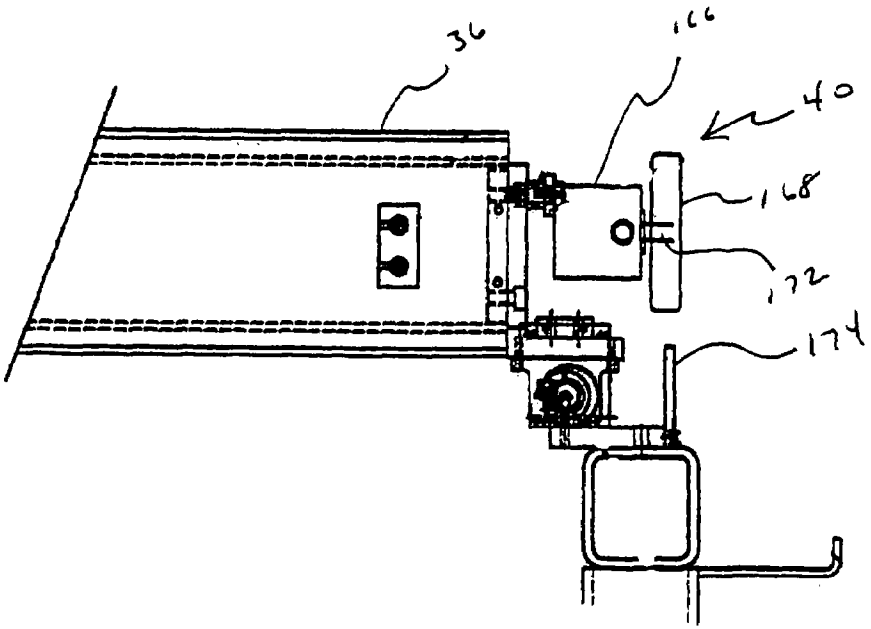
FIG. 9 is a detailed plan view taken from FIG. 7 showing an encoder assembly as utilized in the invention.
Figure 11:
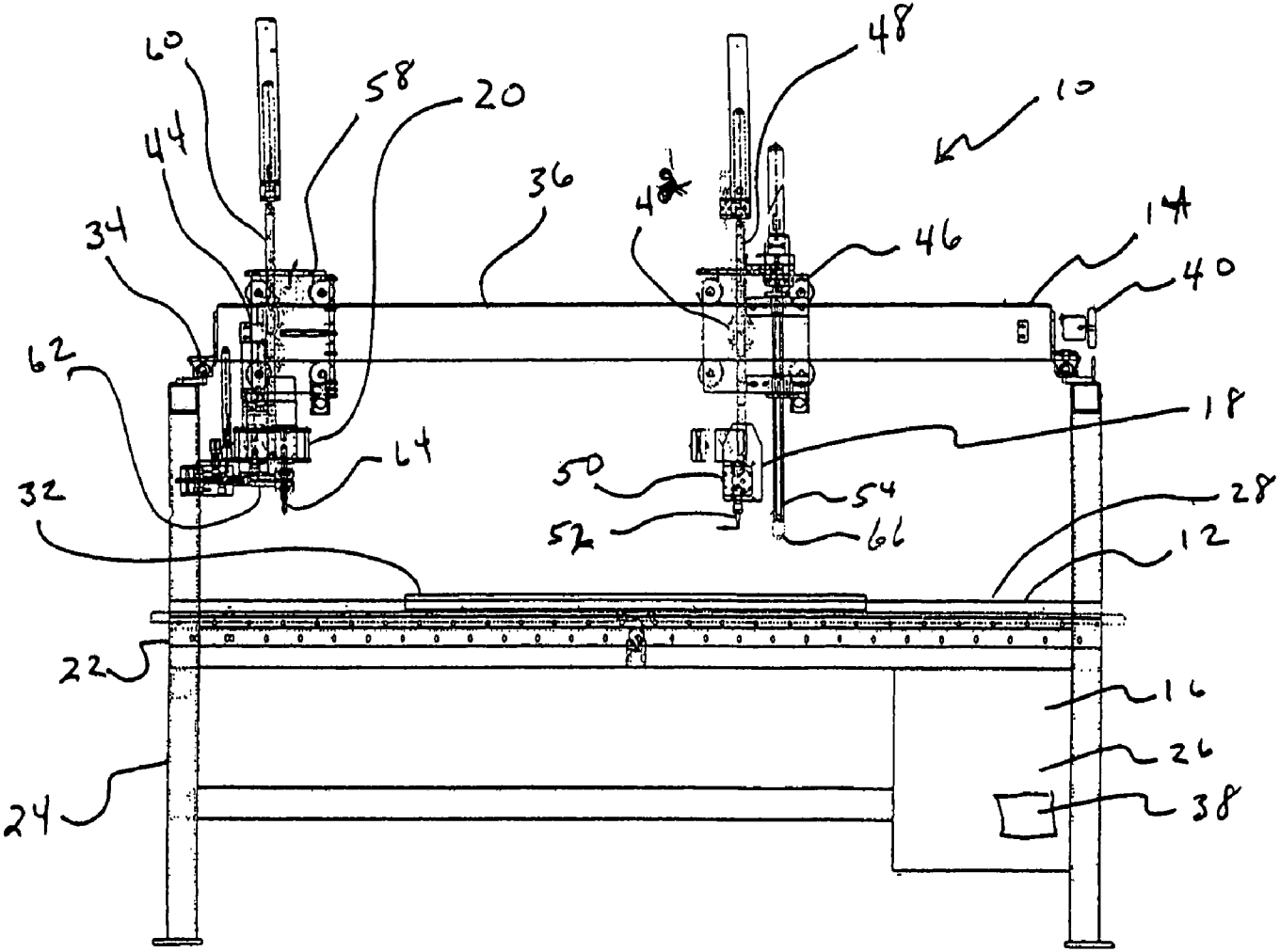
FIG. 11 is a front plan view of an automated glazer in accordance with the invention.
Figure 12:
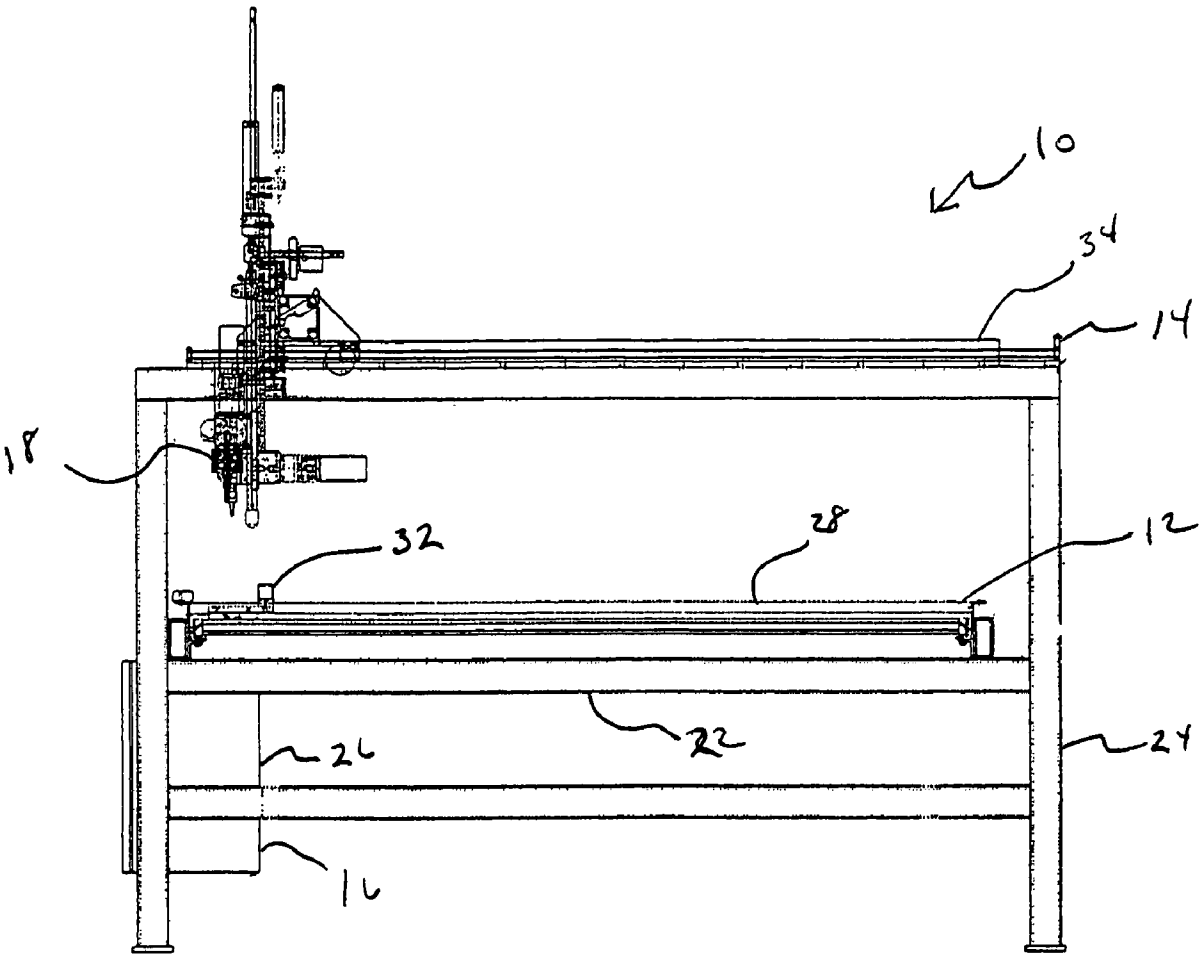
FIG. 12 is a side plan view of the automated glazer depicted in FIG. 11.
Figure 13:
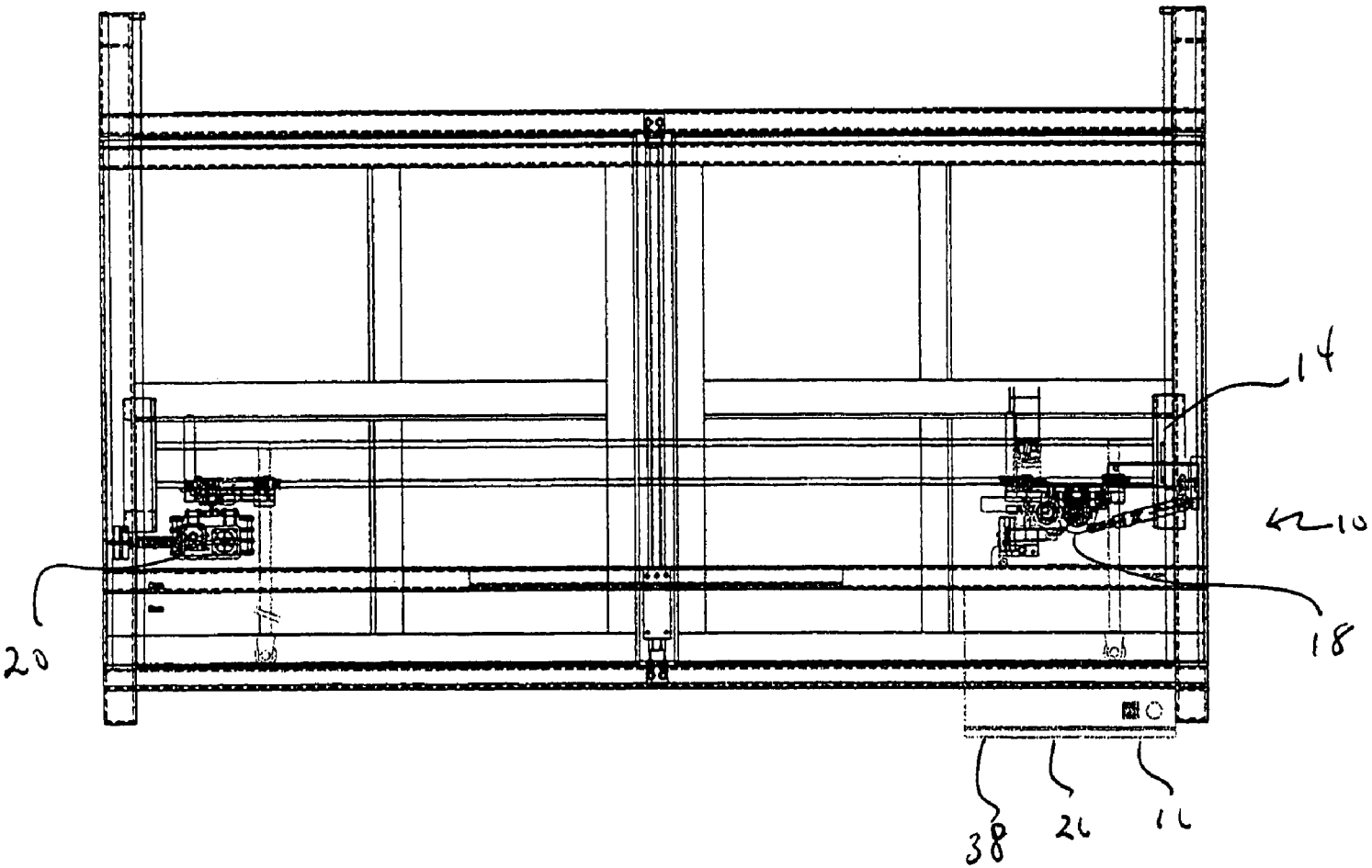
FIG. 13 is a top plan view of the automated glazer depicted in FIG. 11.

Referring to FIGS. 9 and 10, horizontal encoder 130 is depicted. Vertical encoder 128 is similar in structure to horizontal encoder 130. Horizontal encoder 130 includes encoder sensor 166, encoder wheel 168 and encoder arm 170. For horizontal encoder 130, encoder arm 170 is pivotally connected to beam 118. Encoder arm 170 supports encoder sensor 166, which in turn supports encoder wheel 168 on a rotating shaft 172. Encoder wheel 168 bears on rail 174; as beam 118 moves, encoder wheel 168 rotates against rail 174. Encoder sensor 166 then generates signals to a programmable logic controller that are converted into beam position coordinates relative to rail 174. Vertical encoder 128 operates in a similar fashion as will be understood by those skilled in the art.

Figure 24:
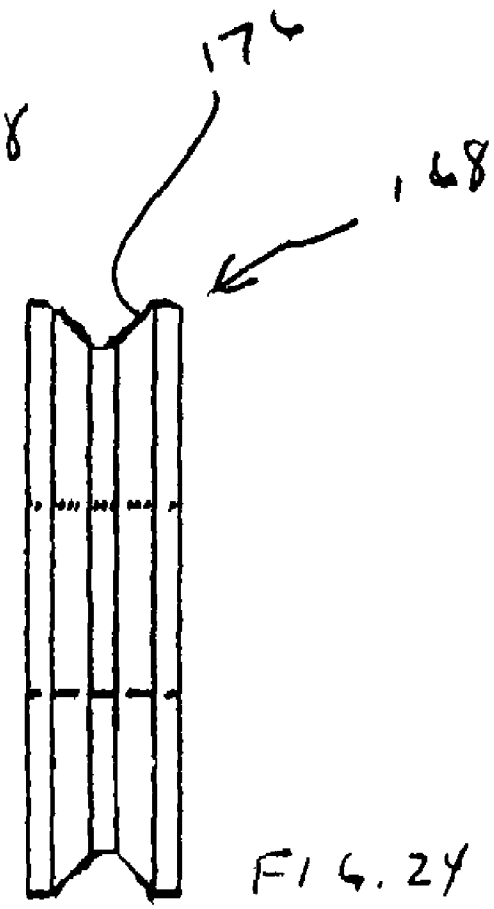
FIG. 24 is a side plan view of an encoder wheel as utilized in the invention.
Figure 23:
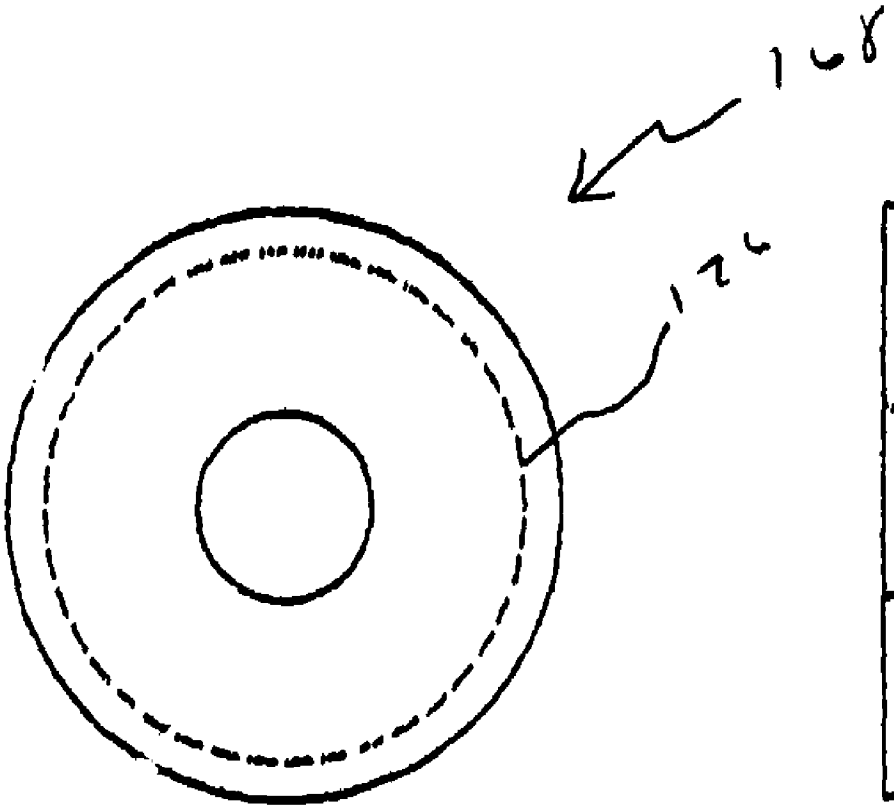
FIG. 23 is a front plan view of an encoder wheel as utilized in the invention.

Referring to FIGS. 23 and 24, an exemplary encoder wheel 168 is depicted. Encoder wheel 168 desirably includes a beveled groove 176 about the circumference thereof. Beveled groove 176 serves to assure non-slip contact between encoder wheel 168 and rail 174.

Figure 25:
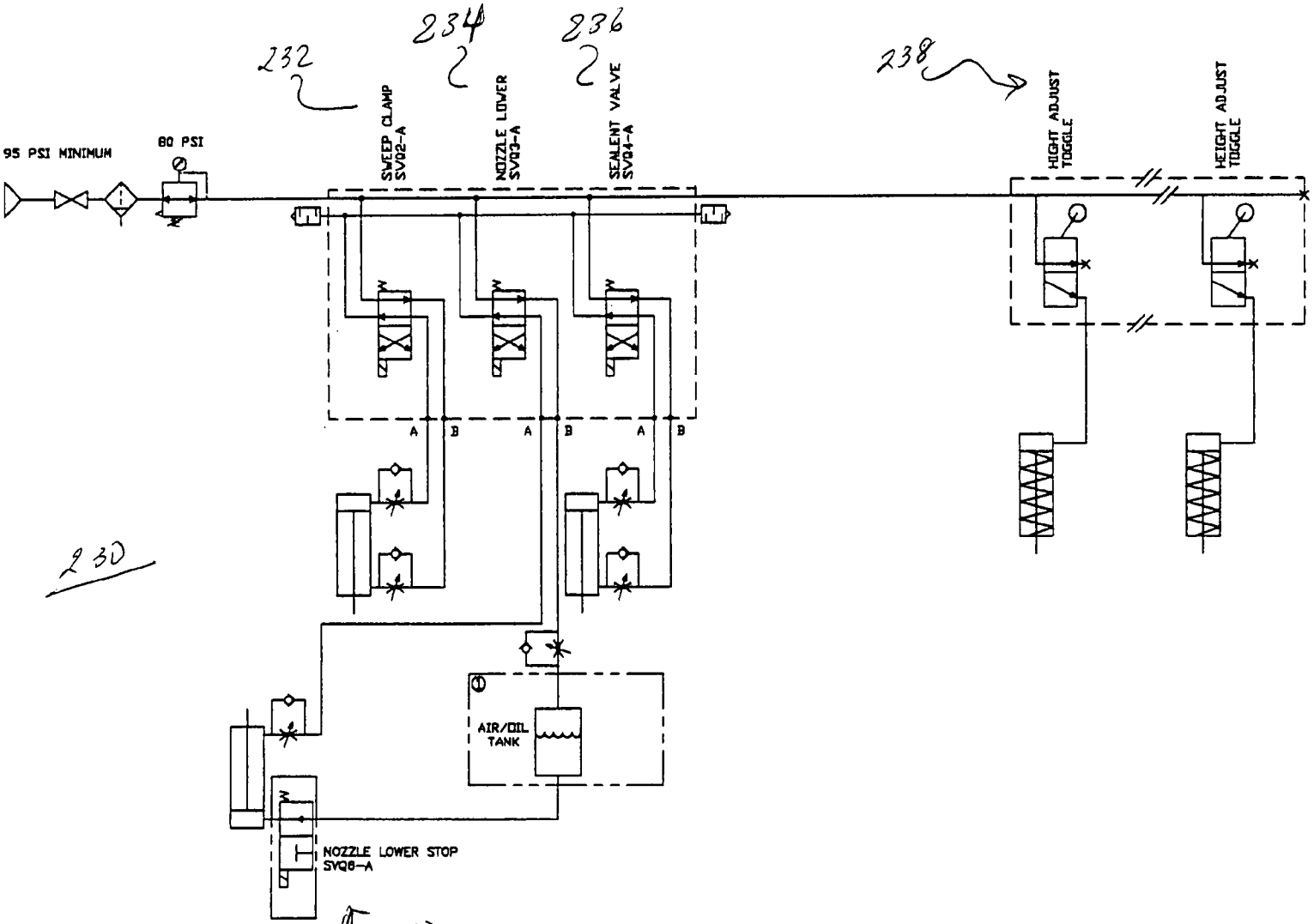
FIG. 25 is a schematic depiction of pneumatic controls as utilized in the invention.

Referring now to FIG. 25, a schematic diagram 230 depicts the various pneumatic controls as utilized in the various embodiments of glazing units described herein. In this example embodiment of the glazing system, there is included a sweep clamp control 232, a nozzle lowering control 234, a sealant valve control 236, a nozzle lower stop control 240 and a height adjust toggle assembly 238. These various controls are controlled by the PLC in the control module.

Figure 26:
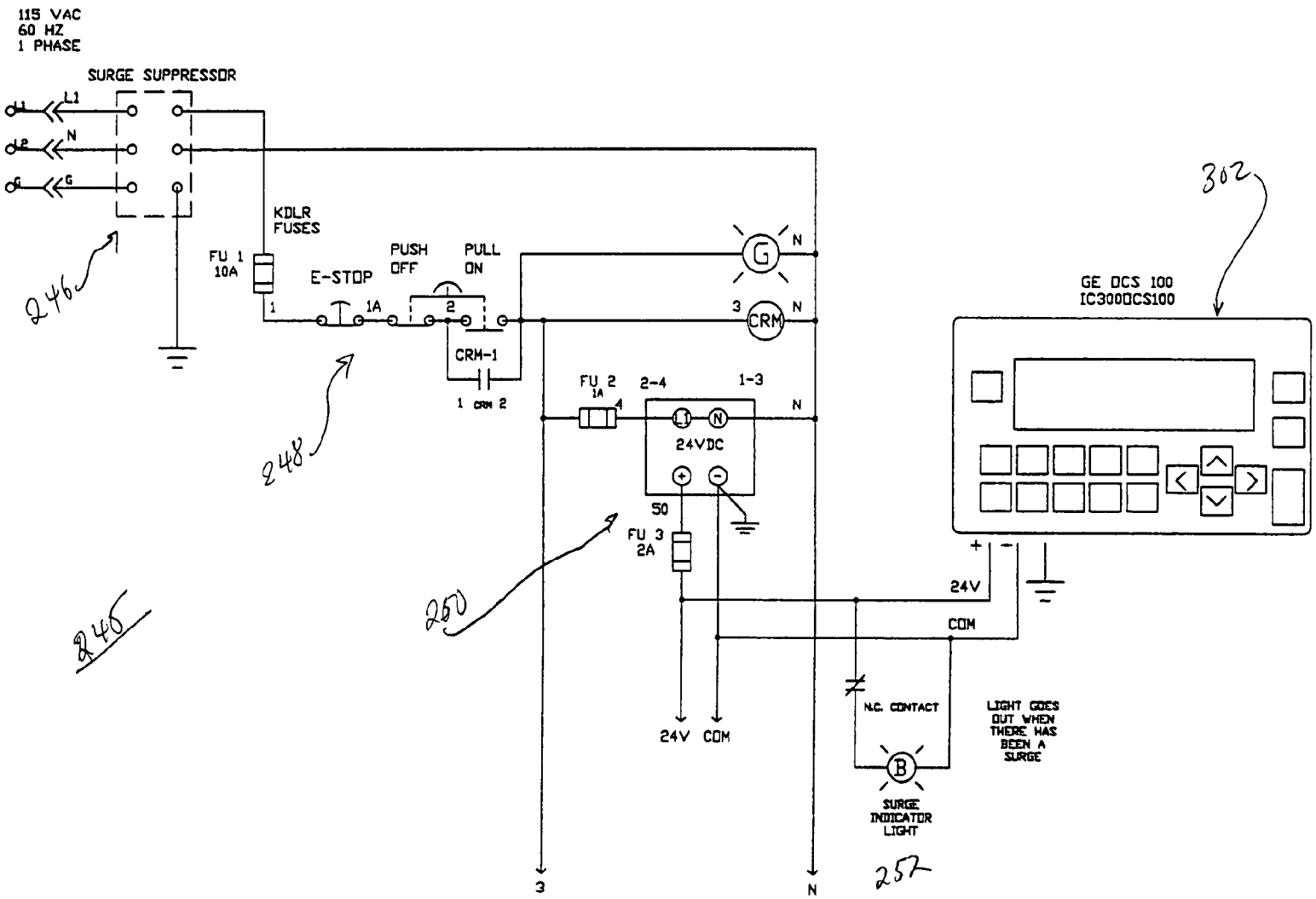
FIG. 26 is an electrical schematic of an AC distribution of an example glazing system as utilized in the invention.

Referring now to FIG. 26, a diagram 245 illustrates an electrical schematic of the AC distribution layout of one example embodiment of the glazing system. In particular, the distribution layout includes a surge suppressor arrangement 246, an emergency stop button assembly 248, a voltage conversion arrangement 250, a surge indicating circuit 252 and a control panel 302 adapted to program the various functions of the glazing system.

Figure 27:
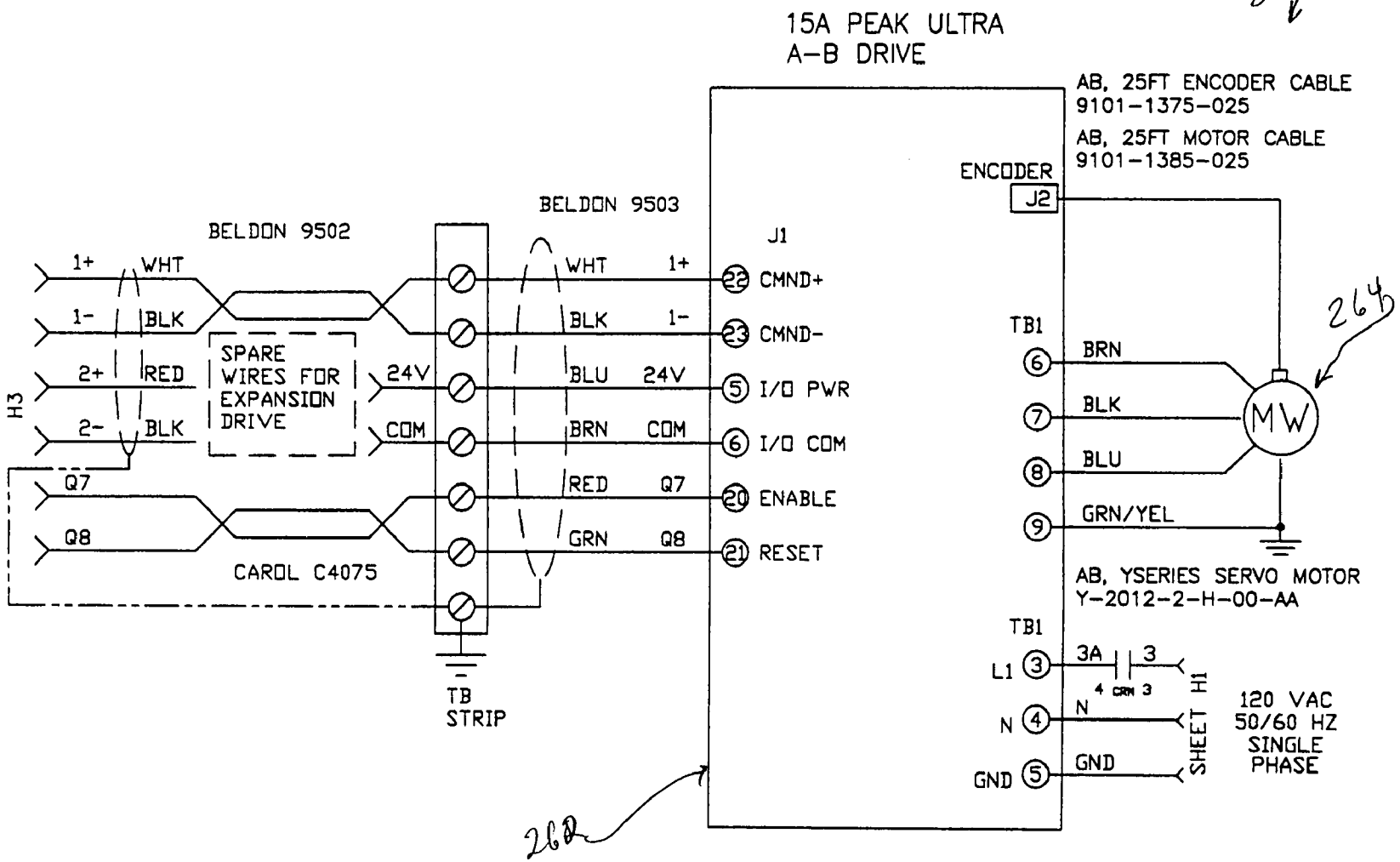
FIG. 27 is an electrical schematic of a servo-motor connection scheme as utilized in the invention.
Figure 28:
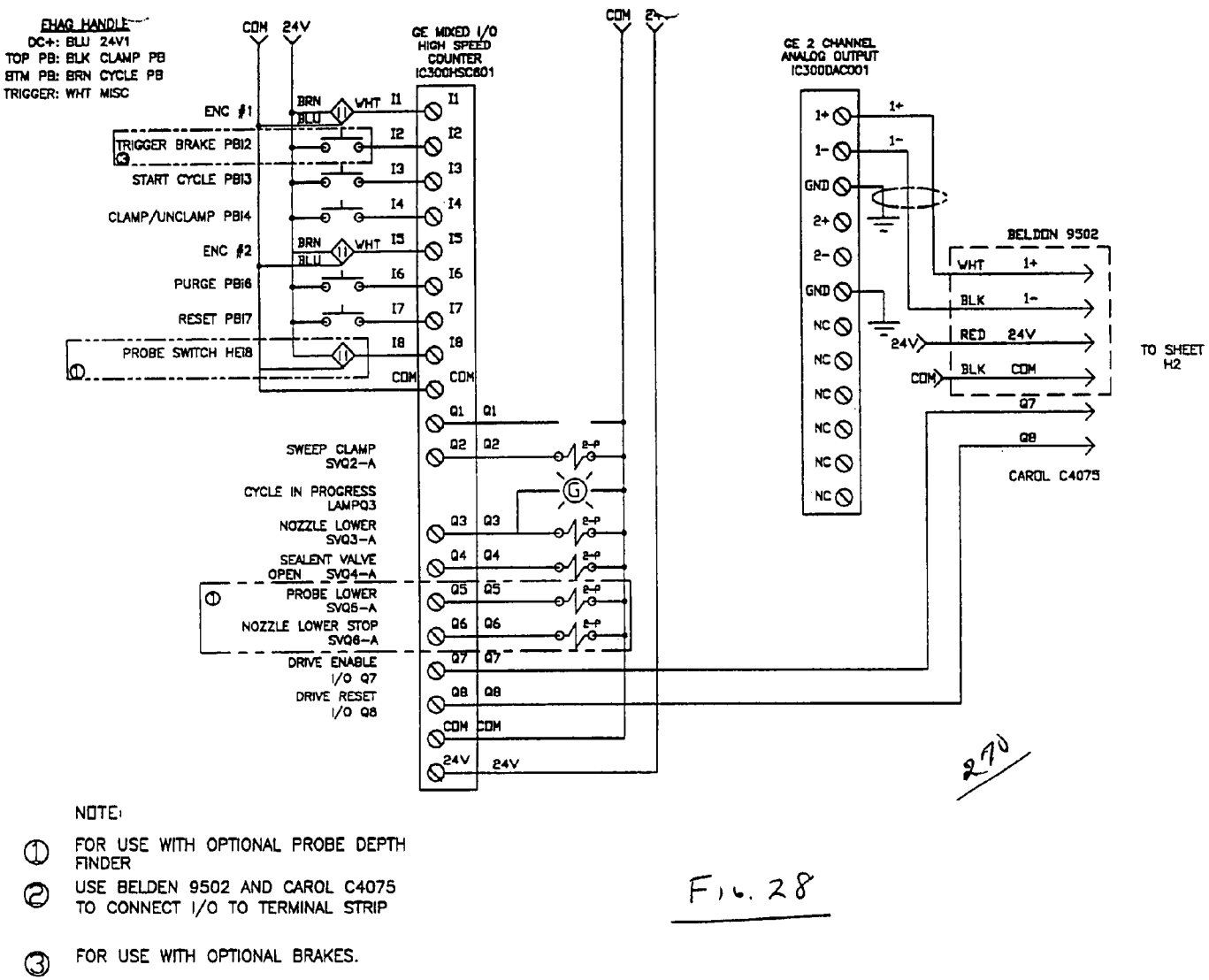
FIG. 28 is an electrical schematic of an I/O connection scheme as utilized in the invention.
Figure 29:
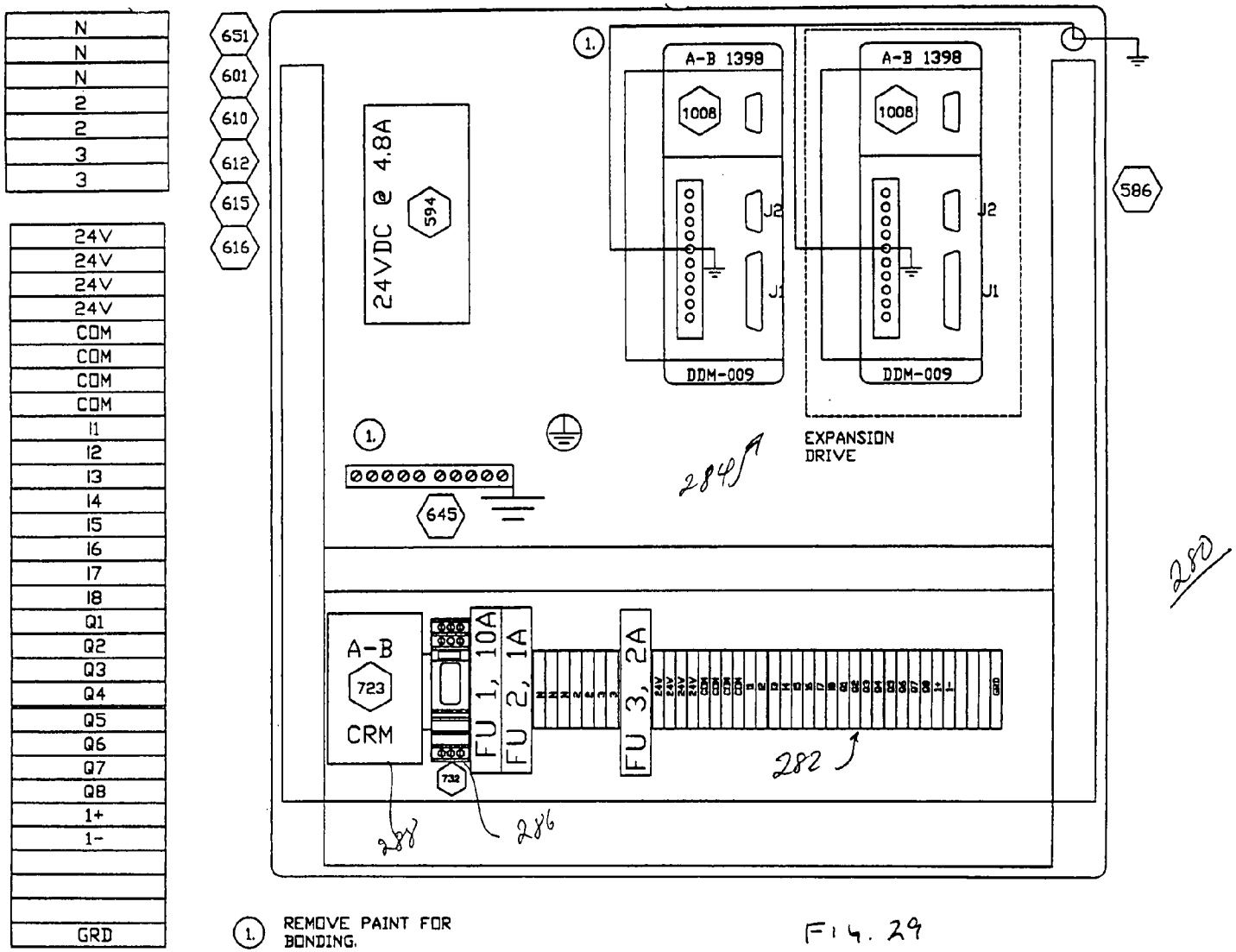
FIG. 29 is a schematic representation of a circuit panel as utilized in the invention.

Referring now to FIGS. 27–29, FIG. 27 is a schematic diagram 260 that illustrates the servomotor and drive connections and layout of an example embodiment of the glazing system described herein. In particular, this arrangement includes a 15 amp ultra peak drive 262 (such as of the type sold by Allen Bradley) electrically connected to a Y-series servo-motor 264 (also sold by Allen Bradley) that is connected to an encoder in drive 262 via a set of encoder/motor cables 266. Referring now to FIG. 28, a diagram 270 illustrates the I/O connections of one example embodiment of the glazing system of the invention back to the drive and servomotor as well as to the pneumatic controls illustrated in FIG. 25. Referring now to FIG. 29, a schematic representation of a circuit panel 280 is illustrated that is coupled to a control panel of an example embodiment of the invention. This example embodiment of the circuit panel includes various fuse panels and terminal blocks 282 as well as a pair of encoders 284 (such as encoder 1200 pulse made by Powermation). Circuit panel 280 further includes a surge suppression module 286 that is electrically connected to an 110V coil with 9 Amp contacts.

Figure 30:
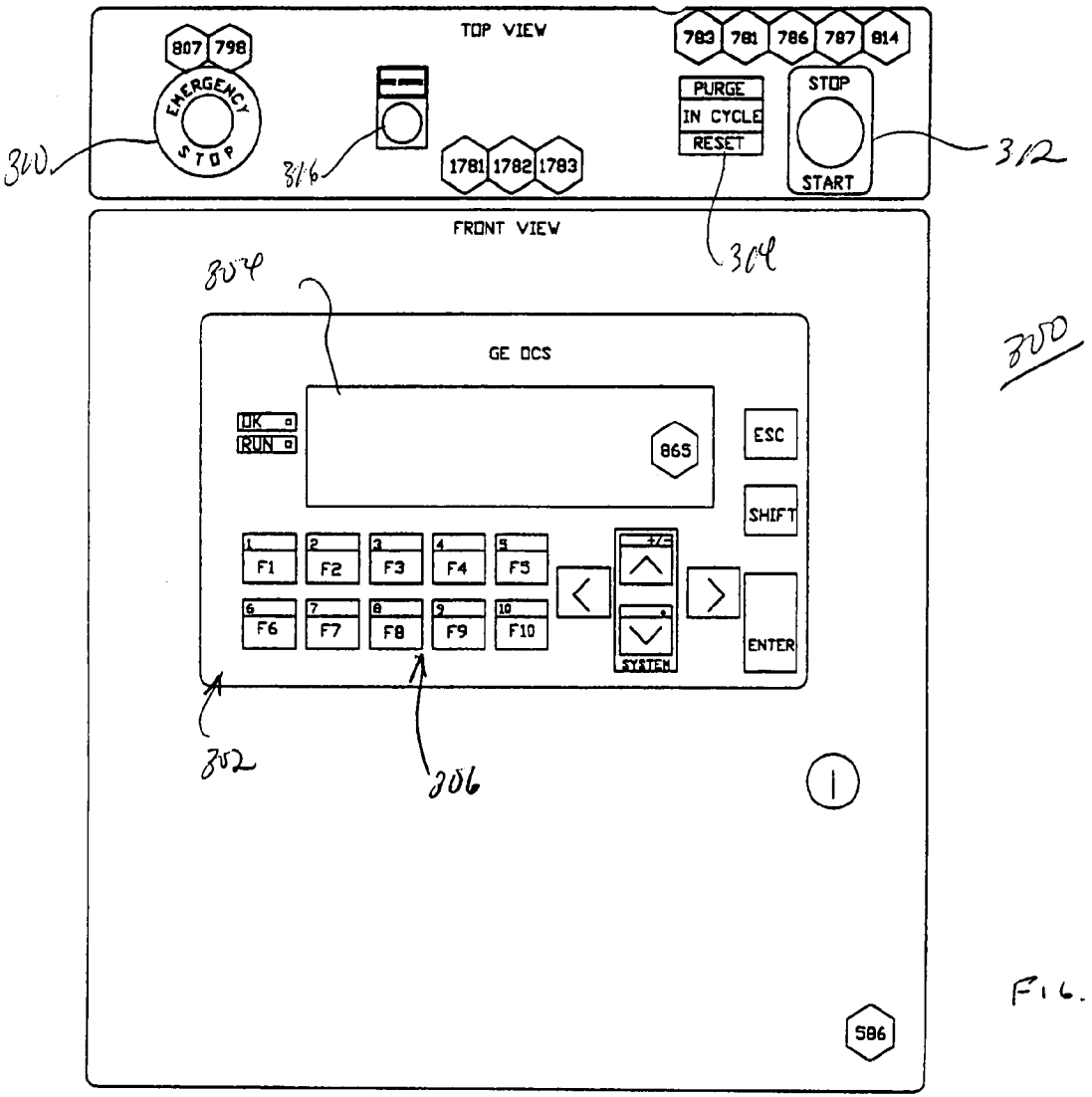
FIG. 30 is a schematic representation of a control panel as utilized in the invention.

Referring now to FIG. 30, there is illustrated a schematic representation of a control panel 300 of the type used in the various embodiment described herein. In this example embodiment, control panel 300 includes a display panel 302, a display screen 304, and a keyboard 306 that encompasses all of the input keys for entering data and altering the settings of the program running on the PLC within the control panel. The top panel of control panel 300 includes an emergency stop button 310, a stop/start button 312 as well as a purge/in-cycle/reset button assembly 314. A surge indicator light 316 is also included.

Referring now to FIGS. 1, 2, 7A and 30, the elements of the control panel will be described as well as the method of glazing a spacerless window sash. The following is an example of how the hand controller of FIG. 7A, in conjunction with control panel 300 of FIG. 30, is utilized in manufacturing a window sash according to one embodiment of the invention. The operator first pulls the EMERGENCY STOP push-pull button 310 on the control module 300; a red light 316 should illuminate. In order to clamp the window or door frame, the operator pushes and releases the TOP (BOOST) BUTTON or the CLAMP BUTTON on the operator handle 202, this will clamp the frame for glazing. If the frame is not clamped properly, push RESET 314 on panel 300 and re-adjust the clamp bar closer to the product. The window frame should be properly clamped to begin either the glazing cycle or the lay-in cycle. After sealing the glass pane in, release the clamp art by pressing the CLAMP button or the TOP (BOOST) button (when not in the glazing cycle) of handle 202. The clamp arm will automatically release at the end of the lay-in cycle.

With respect to the glazing cycle, position the nozzle over the frame opening to avoid contact with the window when the nozzle lowers. Push and release the BOTTOM button on handle 202. This brings the nozzle down to the glazing area (which is adjustable via the pneumatic switches located above the operator handle). Move the nozzle to the desired starting position with the nozzle against the frame. For the best results, start on a straightaway portion of the window. Next, push and release the BOTTOM button on handle 202; a small amount of sealant will be dispensed before the head is moved. Keeping the nozzle in contact with the frame, the operator guides the nozzle around the frame. When approaching a corner, the operator eases in and out gently, making a smooth transition. If additional sealant is required in certain areas, there is a boost function triggered by the TOP button. It is active during the glazing cycle only. When returning to the starting point, push and release the BOTTOM button, and move the nozzle beyond the starting point slightly. This disables the glazing cycle and does a "suck-back" process to minimize the sealant from dripping between cycles. Next, the operator pushes and releases the BOTTOM button on handle 202, which raises the glazing head. To release the clamp, press the clamp button.

Where there is a probing operation, position the nozzle over the rabbet or location from where the nozzle-lower height is to be referenced. The Probe cylinder will lower when the BOTTOM button is first pressed and released. The nozzle will begin to lower the second time the BOTTOM button is pressed and released. The nozzle will lower until the Probe cylinder has retracted far enough to actuate the Probe at Height Hall Effect switch or the Nozzle Lowered timer has timed out. Continue with the earlier steps of the glazing cycle.

A variety of adhesive dispensers can be adapted to the various embodiments of the described glazing apparatus so as to dispense heated sealants and multiple part adhesives. The various embodiments of the invention also include an easy flow valve that operates with a wide body gear metering assembly to dispense sealant evenly and quickly on the product. The glazing system can also include a quick-change nozzle for sealant dispensing or can be fitted with a quick-close nozzle assembly that resolves the problem of "threading." Threading involves the leakage of long, thin strands of adhesive that ooze out of a nozzle after the flow of a viscous adhesive is shut-off).

Figure 31:
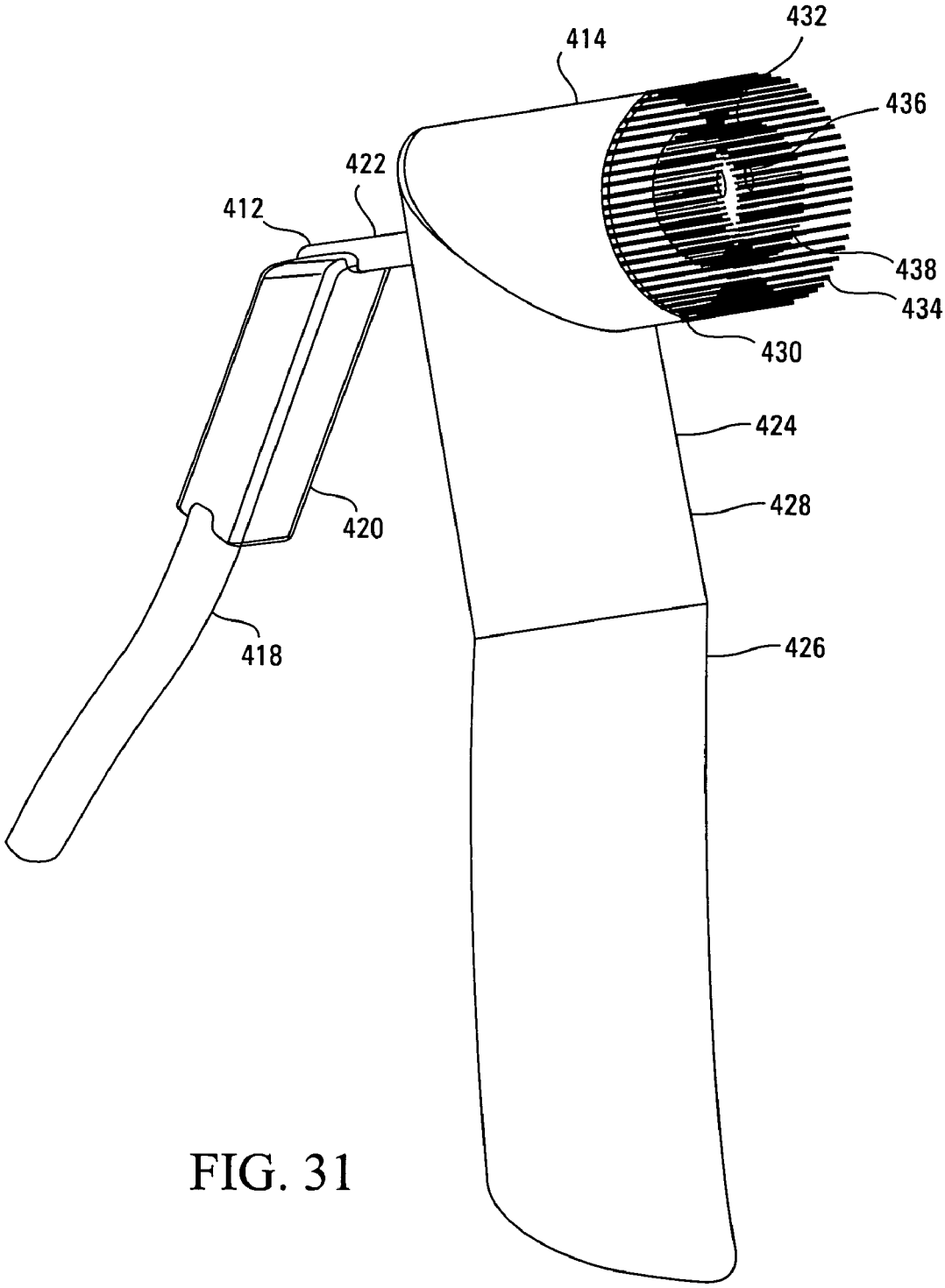
FIG. 31 depicts an ionized air gun vacuum dust collector tool in accordance with the invention.
Figure 32:
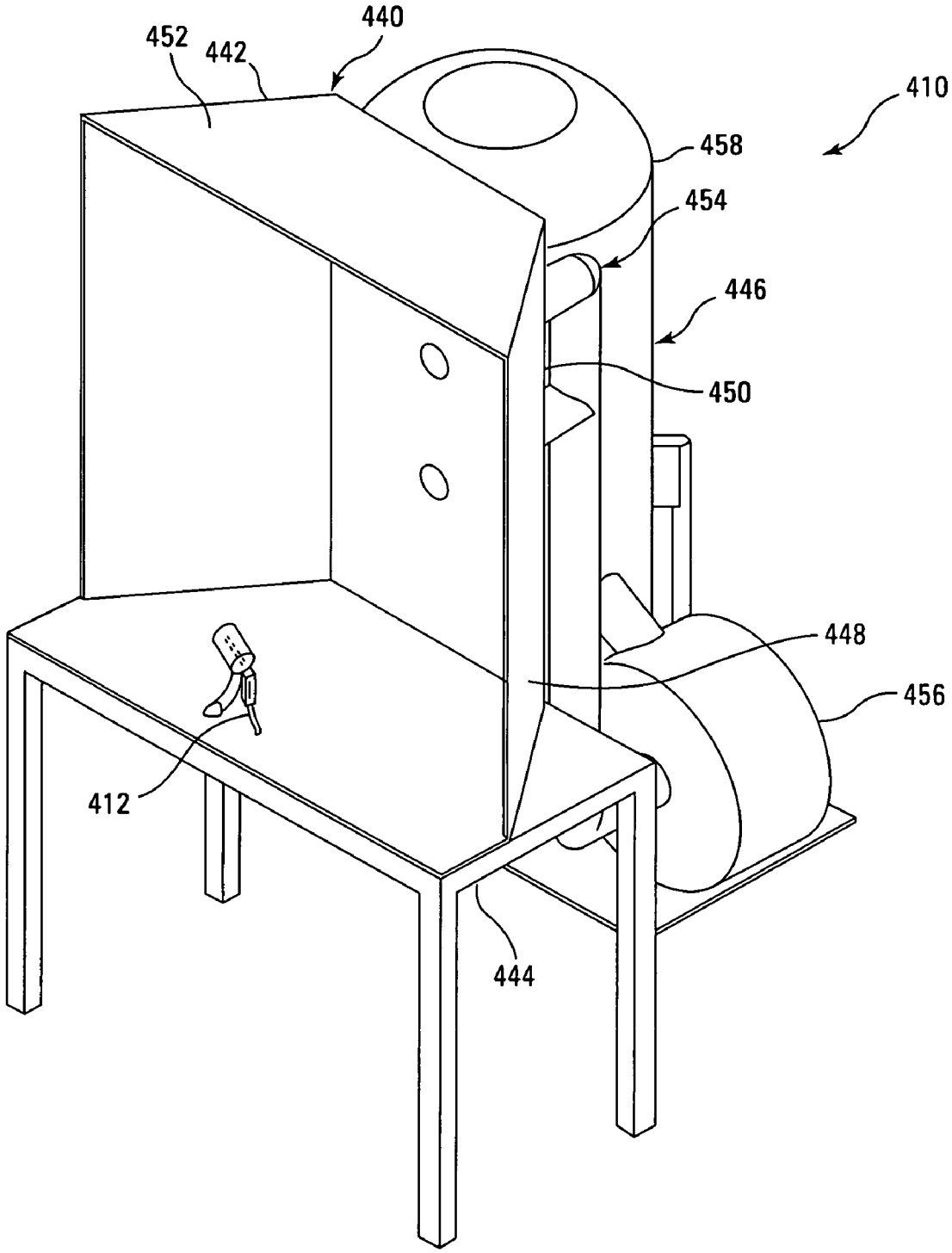
FIG. 32 depicts a workstation including a dust hood and dust collector in accordance with the invention.

The various embodiments of the glazing systems describe above can also include an ionized dust removal system that is in close proximity to improve on the quality of the end product and improve overall production yield of the windows being manufactured. Referring now to FIGS. 31 and 32, the ionized dust removal system 410 generally includes an ionizing air gun 412, a vacuum dust collector 414 and a dust hood 416. Ionized air gun 412 generally includes air supply 418, handle 420, nozzle 422 and an air ionizer (not shown) connected to air supply 418. Air supply 418 supplies compressed air that has been treated by the air ionizer. Handle 420 is conveniently sized to fit the hand of an operator. Nozzle 422 directs a flow of ionized air at an object that the operator desires to clean. Desirably, ionized air gun 412 releases a balanced stream of compressed ionized air that neutralizes the charge that can form on non-conductive surfaces and can hold particulates to the surface. Loose particles can then be easily blown, dusted or vacuumed away.

Vacuum dust collector 414 generally includes a vacuum head 424 and a vacuum hose 426. Vacuum head 424 includes neck 428 and intake 430. Ionized air gun 412 is attached to vacuum head 424 such that nozzle 422 passes through intake 430 in a coaxial fashion. Intake 430 is structured to surround nozzle 422 such that intake 430 is an annular structure drawing in air to be carried away via vacuum head 424 and vacuum hose 426. Vacuum head 424 further includes inner concentric bristles 432 and outer concentric bristles 434. Inner concentric bristles 432 surround nozzle 422 and provide a partially closed inner cylindrical chamber 436 into which nozzle 422 discharges ionized air. Outer concentric bristles 434 surround intake 430 and border outer annular chamber 438.

Referring to FIG. 432, dust hood 416 is generally configured as a workstation 440 that includes hood enclosure 442, table 444 and dust collector unit 446. Hood enclosure 442 is desirably supported on top of table 444. An exemplary hood enclosure 444 includes sidewalls 448, back wall 450 and top 452. Hood enclosure 442 may take many other structural forms as will be apparent to those skilled in the art.

Hood enclosure 442 is in operable fluid communication with dust collector unit 446 by way of dust transfer ducts 454. Dust transfer ducts 454 may be constructed of flexible or rigid ductwork. Rigid ductwork is preferred in order to minimize frictional airflow loses with the walls of dust transfer ducts 454. Dust transfer ducts 454 interconnect hood enclosure 442 with dust collector unit 446. Dust collector unit 446 is desirably a commercial dust collector including blower 456 and filtering elements 458. It is desirable that blower 456 be of a capacity sufficient to continuously draw air from hood enclosure 442 and from vacuum dust collector 414. Filter element 458 should be configured to filter out particulate matter of the size expected when cleaning articles to be cleaned.

In operation, an operator places an article to be cleaned on table 444 at workstation 440. The operator then turns on dust collector unit 446 and ionized air gun 412. The operator then grasps ionized air gun 412 by handle 420 and positions it against the article to be cleaned so that inner concentric bristles 432 and outer concentric bristles 434 are in contact with the article to be cleaned. The operator then releases a balanced stream of compressed ionized air to flow through inner cylindrical chamber 436 over the article to be cleaned while moving inner concentric bristles 432 and outer concentric bristles 434 over the object to dislodge any attached particles. The flow of air into outer annular chamber 438 into intake 430 then carries away dust and particulate matter that is dislodged from the article to be cleaned. In addition, any dust or particulate matter that is shaken loose from the article to be cleaned that is not drawn in to vacuum dust collector 414 will be collected and isolated by being drawn into hood enclosure 442 and ultimately into dust collector unit 446, where it is trapped by filtering elements 458.

Figure 33:
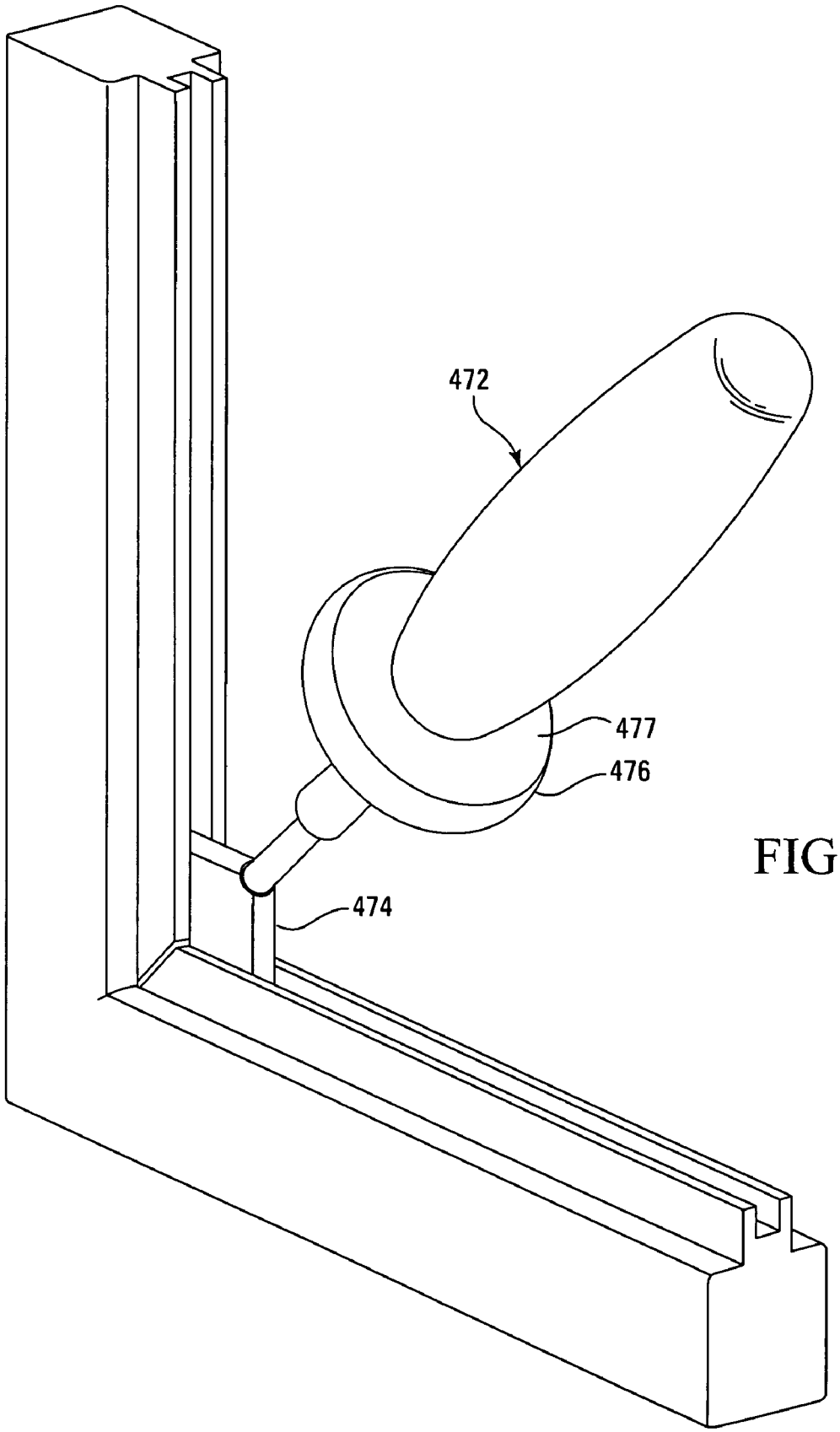
FIG. 33 is a perspective view of a weld bead removal tool in accordance with the invention.

In assembling windows and door frames using the various embodiments of the glazing systems described above, some additional processing steps are recommended to improve the quality, durability and reliability of the finished window or door frame. Spacerless sashes are generally constructed by assembling extruded straight sections that have been mitered at the corners. The mitered corners are fused together by the use of polymer welding techniques. When the mitered corners are welded a raised bead is formed on the interior of the sash corner. It is desirable to remove this bead to provide a smooth interior surface within the sash. The bead may be removed by machining but this tends to disrupt the integrity of the welded joint. Referring to FIG. 33, removing the overweld may be done with a weld removal tool 472. The weld removal tool 472 generally includes a heated platen 474 and a supporting structure 476.

The heated platen 474 is generally a flat plate 478 sized to fit snugly into, for example, the desiccant space of the window frame. The thickness of heated platen 474 is matched to the width of the desiccant space. The shape of heated platen 474 is matched to the inner contour of the corner of the sash. For example, for a square or rectangular sash the platen 474 has a right-angled corner. For an octagonal sash the platen 474 has a forty-five degree angled corner. In the case of a circular or oval sash platen 474 may have a rounded contour. Supporting structure 476 can be an insulated handle 477 for manual use as depicted in FIG. 33. In addition, supporting structure 476 may form a portion of an automated mechanism such as an automated notcher.

Figure 34:
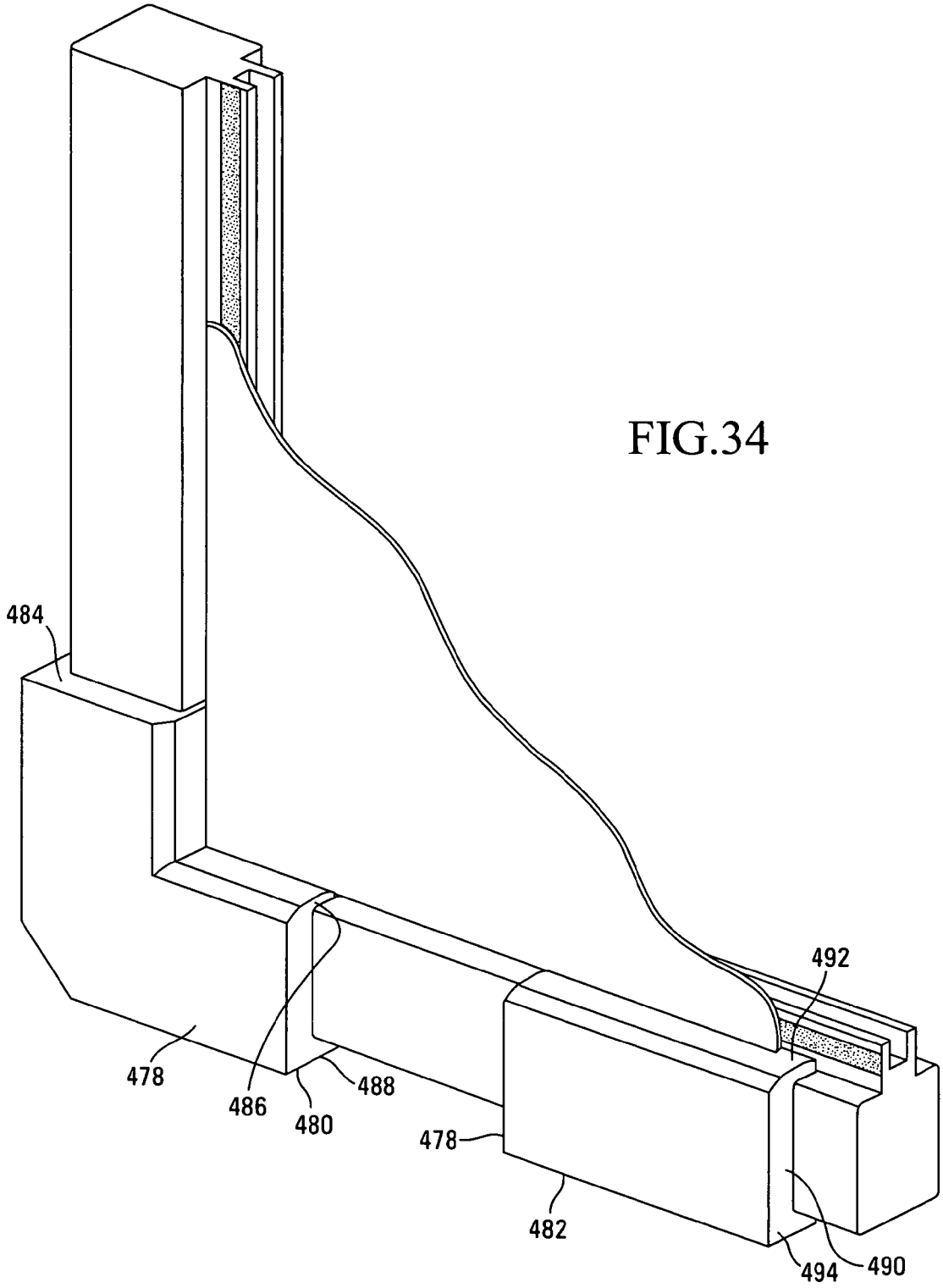
FIG. 34 is a perspective view of glass setting blocks in accordance with the invention.

In order to ensure that the glass panes are positioned properly within the sash, setting blocks 478, as illustrated in FIG. 34, are utilized. Setting blocks 478 include corner block 480 and side block 482. The material from which spacerless sashes are made expands and contracts at a rate different from the panes. In addition, if the glass shifts before the sealant sets the glass will reposition itself causing the sealant to smear on the glass. The glazed sash should then be discarded since it is difficult to satisfactorily repair this defect. Therefore, it is important that appropriate spacing be maintained between the pane edges and the sash. Setting blocks assist in maintaining spacing.

Corner block 480 generally includes body 484, inner flange 486 and outer flange 488. Inner flange 486 is sized to maintain appropriate separation between the glass pane and the edge of the sash. Body 484 and outer flange 488 closely conform to the shape of the sash so as to grip the sash and hold inner flange 486 in place. Side block 482 is similarly structured including body 490, inner flange 492 and outer flange 494. Side block 482 functions similarly to corner block 480.

Figure 35:
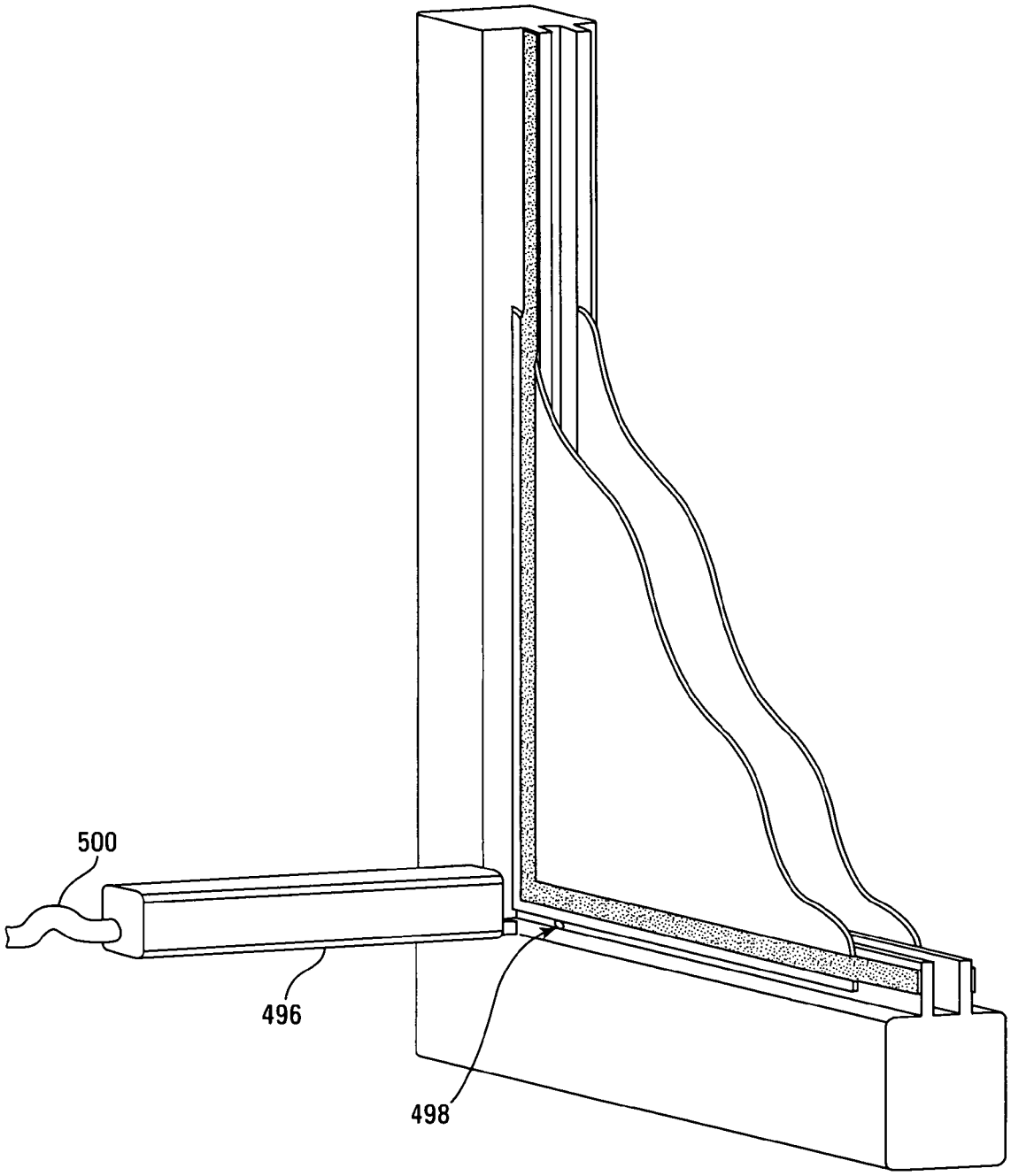
FIG. 35 is a perspective view of a vacuum glass seater in accordance with the invention.

Referring to FIG. 35, after glass panes are positioned with setting blocks 478 (not shown in FIG. 35 for clarity), vacuum glass seater 496 is inserted into gas porthole 498. A vacuum pump (not shown) is used to draw gas out of the insulated glass window via vacuum line 500. Atmospheric pressure then forces panes toward the spacerless sash and into the sealant to seat the pane. In the case of large panes it may be necessary to support the center of the pane with vacuum cups (not shown) to reduce the risk of cracking the glass.

As described above, spacerless sash units include a groove or channel around the perimeter of the spacerless sash that will be enclosed between the two panes of glass when the spacerless sash unit is assembled. This groove or channel accommodates the application of dessicants. In particular, some spacerless sashes are treated with a desiccated barrier material to reduce the infiltration of gasses through the spacerless sash material even further. In this situation, it is desirable for the desiccated barrier material to be applied to the bottom and both sides of the groove.

Figure 37:
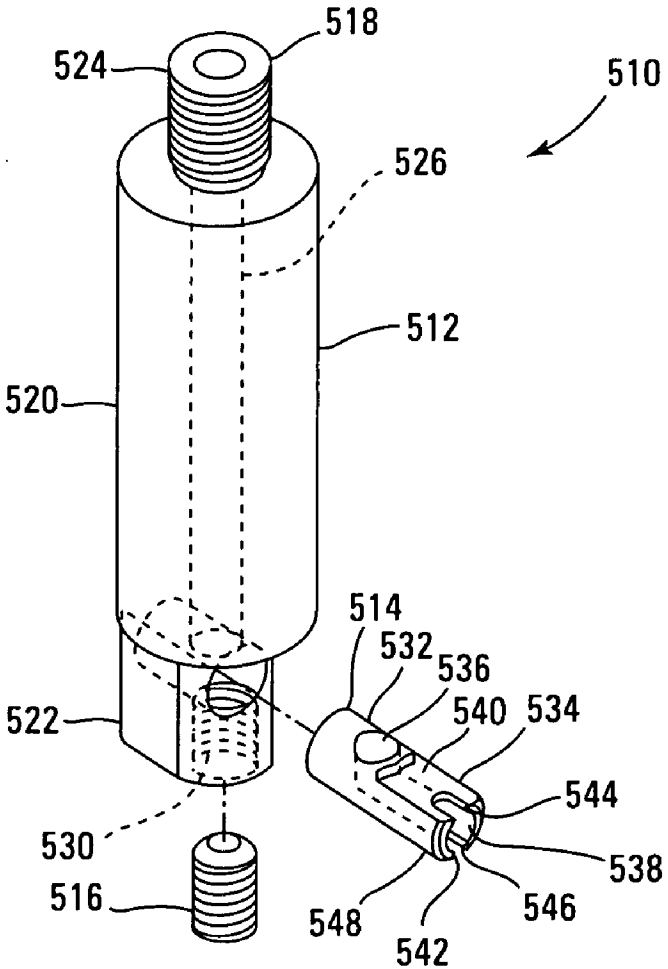
FIG. 37 is an exploded perspective view of the multipiece nozzle of the present invention.
Figure 36:
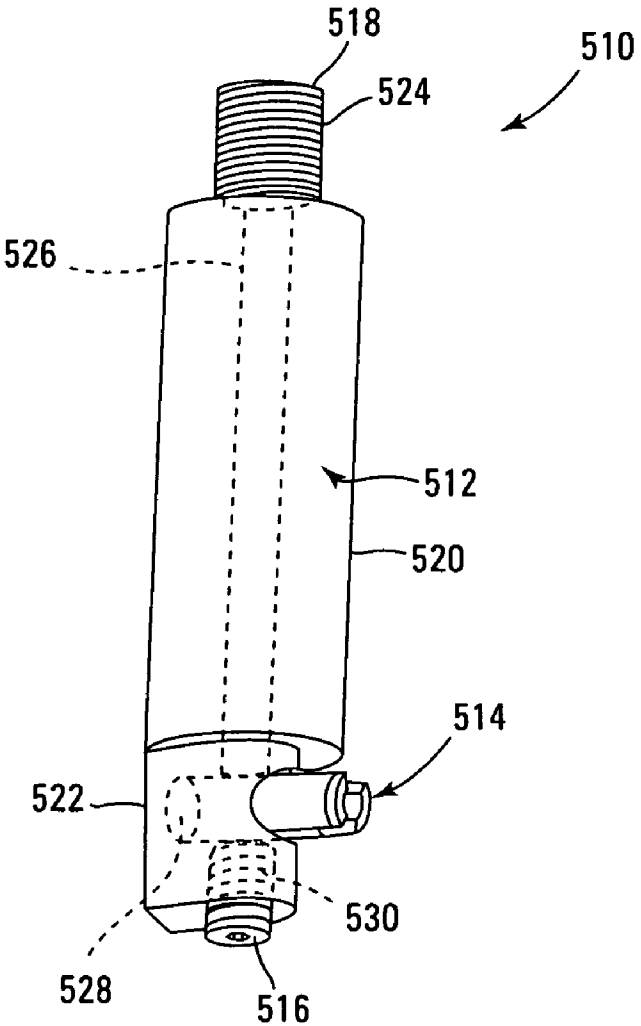
FIG. 36 is a perspective view of the multipiece nozzle of the invention.
Figure 38:
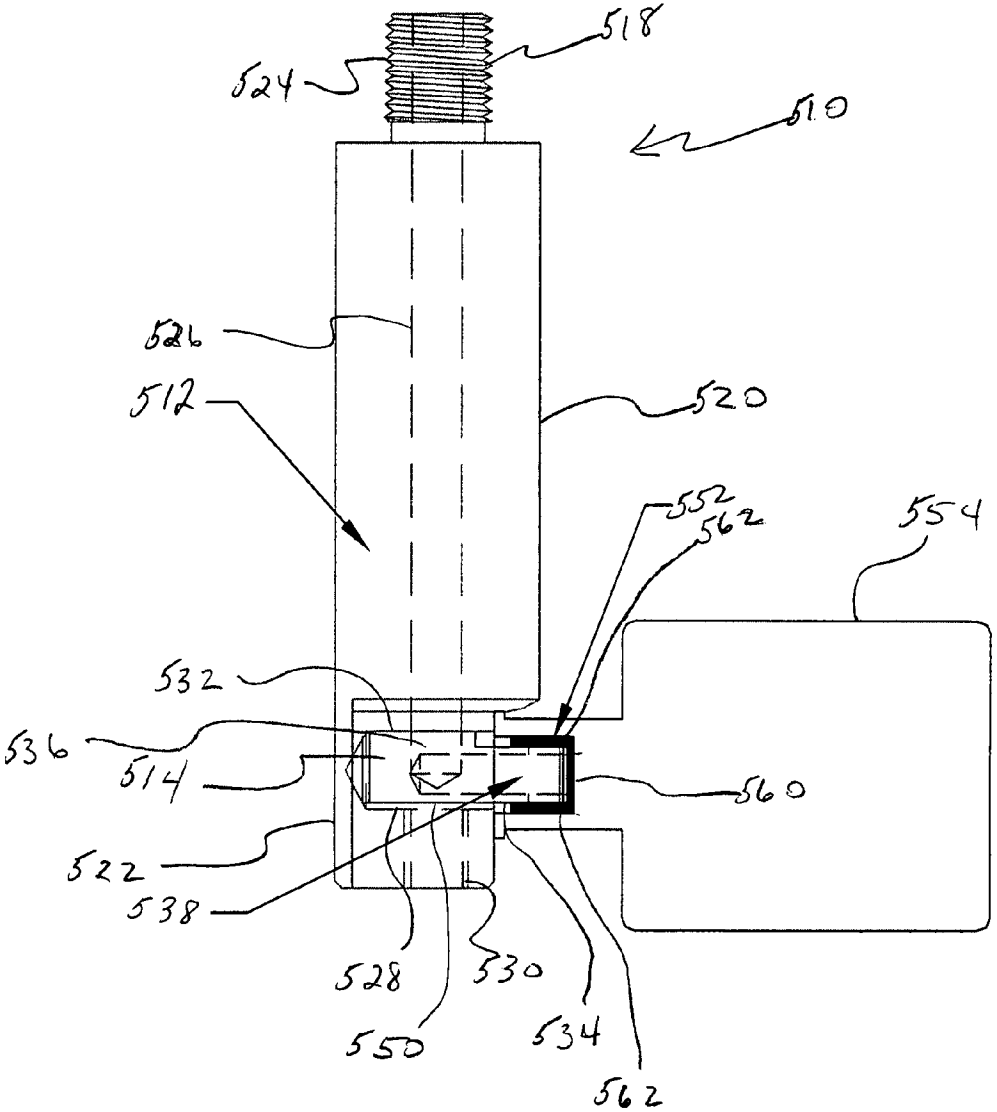
FIG. 38 is a sectional view of the multipiece nozzle including phantom lines showing channels in the multipiece nozzle dispensing dessicated barrier material into a spacerless sash.
Figure 39:
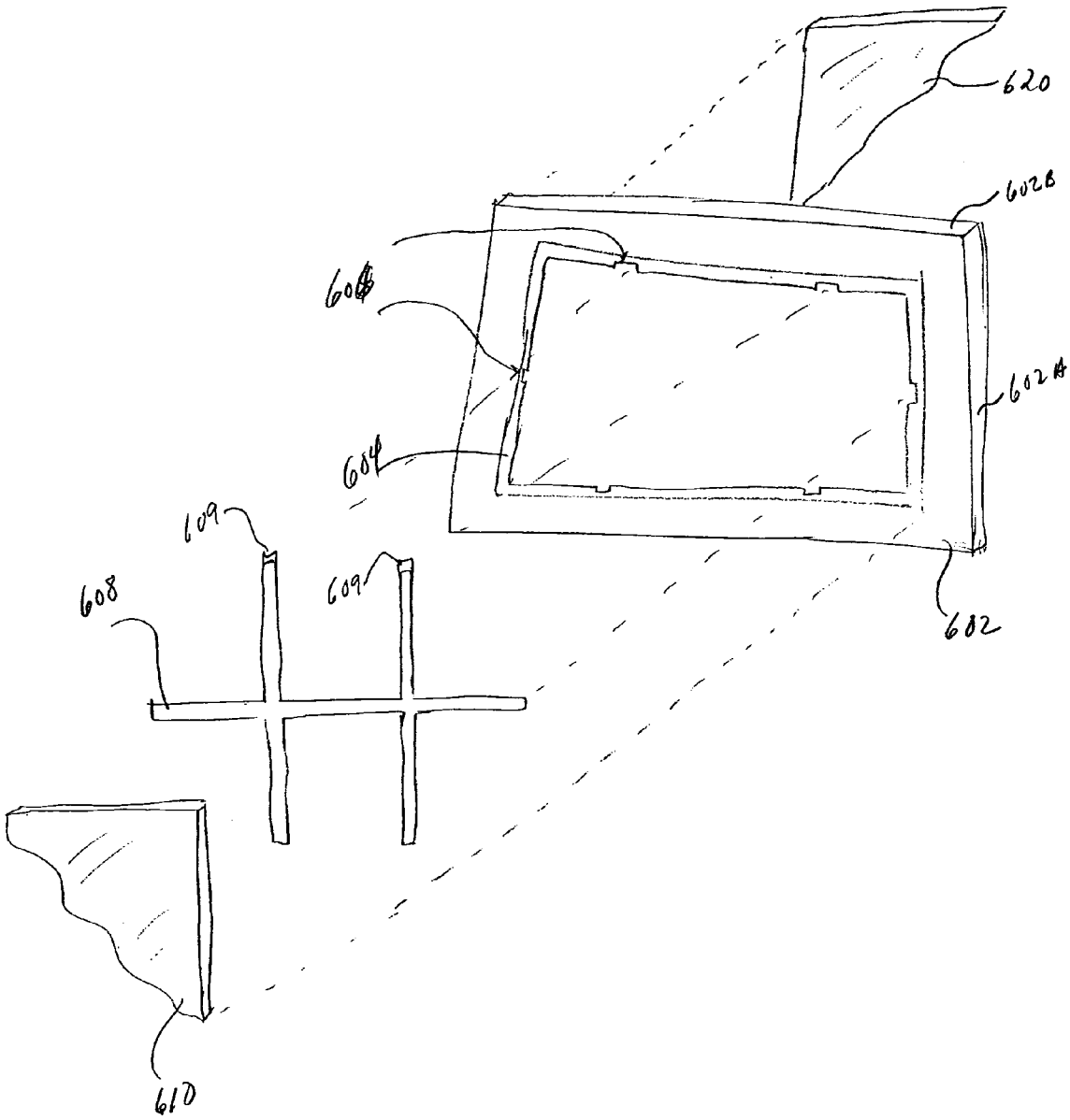
FIG. 39 is an exploded view of a simulated mullion window assembly made in accordance with the invention.
Figure 40B:
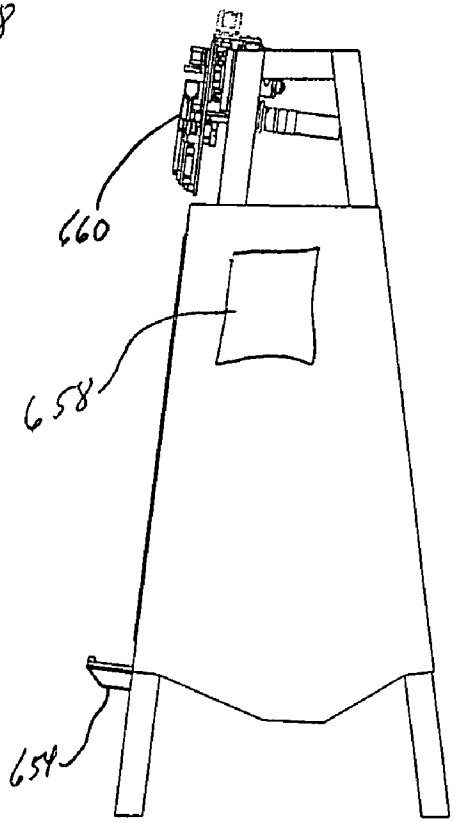
FIGS. 40A–40B are front, side and top view of a notching assembly made in accordance with the invention.
Figure 40A:
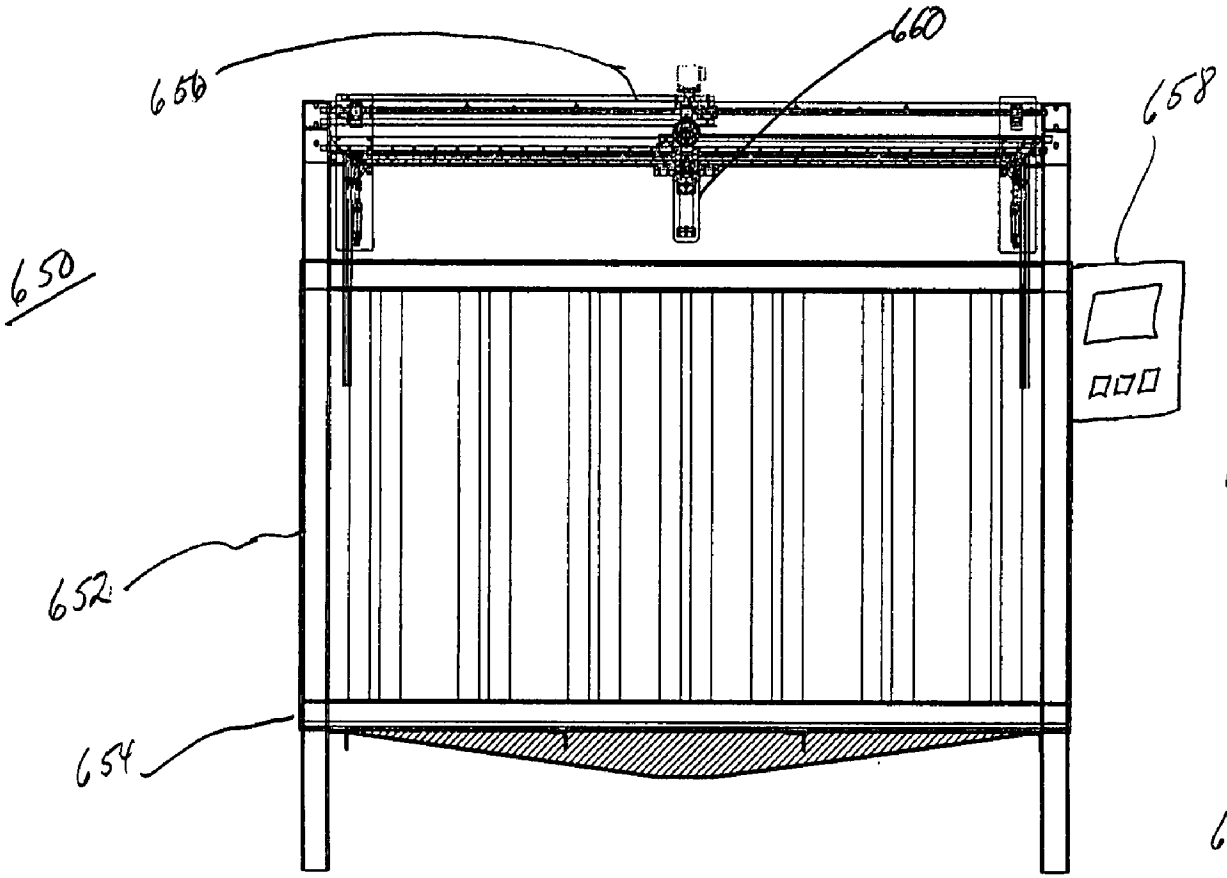
Figure 41B:
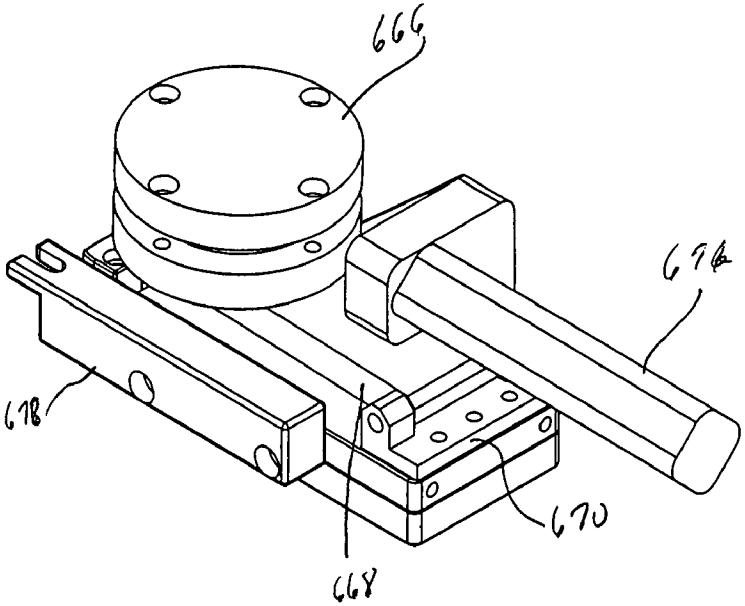
FIGS. 41A–41B are two perspective views of a manual notching assembly made in accordance with the invention.
Figure 41A:
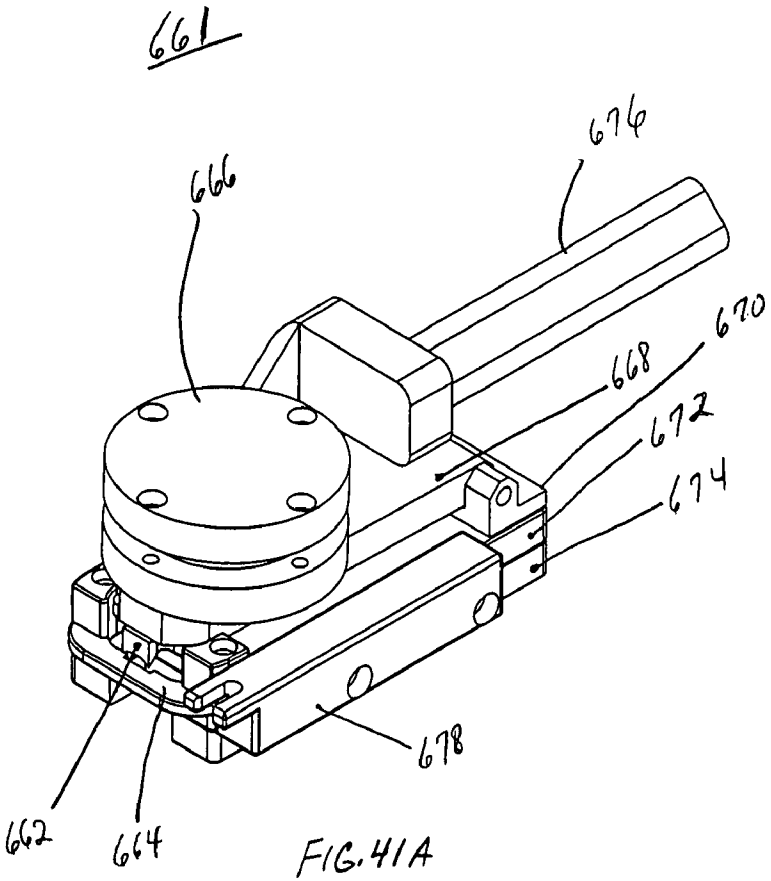

Referring now to FIGS. 36–38, in operating various embodiments of the glazing systems described herein it is desirable to have a nozzle adapted to apply desiccated barrier material into the groove of the sash frame and to coat both sides and the bottom of the groove simultaneously. FIGS. 36 and 37 illustrate a three-sided applicator nozzle 510 generally includes a nozzle body 512, a removable tip 514 and a setscrew 516. Body 512 includes a mounting portion 518, a barrel 520 and tip support 522. Mounting portion 518 may support threads 524. Mounting portion 518 may be adapted for other sorts of mounting including bayonet mounts or other types of connectors known in the art. Barrel 520 desirably has an extended cylindrical shape. Mounting portion 518 and barrel 520 are pierced by a fluid passageway 526 that is connected to a source of fluid under pressure or a source of metered fluid (not shown).

Tip support 522 is also pierced by fluid passageway 526. Tip support 522 further defines tip receptacle 528 and setscrew receptacle 530. Tip support 522 desirably has a generally hemi-cylindrical shape that allows tip receptacle 528 to be set back from the edge of barrel 520. Desirably, tip receptacle 528 is a cylindrical cavity oriented generally normal to fluid passageway 526 with set screw receptacle being co-axial with fluid passageway 526. Setscrew receptacle 530 is threaded to receive threaded setscrew 516. Setscrew 516 may be of an Allen screw type or any other type adapted for receiving a wrench.

Referring to FIG. 38, tip 514 is a generally cylindrical structure that generally includes a cylindrical portion 532 and a faceted portion 534. Cylindrical portion 532 is sized for a close fitting acceptance into tip receptacle 528. Cylindrical portion 532 is desirably pierced by perpendicular passage 536 that may be oriented collinear with passageway 526. Perpendicular passage 536 is in fluid communication with an axial lumen 538 that interconnects cylindrical portion 532 to faceted portion 534 and which is centered on a longitudinal axis of tip 514. In addition, faceted portion 534 includes two opposed flat facets 540 and 542. Desirably, flat facet 540 is located one hundred eighty degrees from flat facet 542. Flat faceted 540 and flat facet 542 each define opposed arched outlets 544 and 546. Tip 514 also defines beveled edges 548.

Tip 514 also defines, in cylindrical portion 532, a dimple 550 for receiving the tip of setscrew 516. As best illustrated in FIG. 38, faceted portion 534 of tip 514 is desirably structured so that flat facet 540 and flat facet 542 are separated by a distance that is slightly less than the width of desiccant groove 552 in spacerless sash 554. Further, the exposed length 556 of faceted portion 534 is slightly less than the depth 558 of desiccant groove 552. In addition, tip support 522 is adapted to rest against the edge of spacerless sash 554 to fix the depth to which tip 514 extends into desiccant groove 552. Thus, the thickness of the layer of desiccant material applied to the bottom 560 of desiccant groove 552 is determined by subtracting the exposed length 556 of faceted portion 534 from the depth 558 of desiccant groove 552. In addition, the thickness of the layer of desiccant material applied to the sides 562 of desiccant groove 552 is determined by subtracting the distance between facets 564 from the width 568 of desiccant groove and dividing by two.

In operation, as illustrated in FIG. 38, tip 514 is inserted into tip receptacle 528 in tip support 522. Set screw 516, if not already in receptacle 530 is inserted into setscrew receptacle 530. Setscrew 516 is tightened against dimple 550 in cylindrical portion 532 in order to secure tip 514 in tip support 522. The orientation of tip 514 relative to tip support 522 is basically fixed by the position of dimple 550. Three-sided applicator nozzle 510 is attached to a source of fluid (or viscous) material (such as a desiccant or adhesive material if used in another application) under pressure or a metered fluid (not shown). Thereafter three-sided applicator nozzle is brought into contact with spacerless sash 554 so that tip support 522 rests against spacerless sash 554 and tip is inserted into desiccant groove 552. It is to be noted that tip support 512 is sized so that when the interior corner formed by junction of tip support 522 and barrel 520 rests against spacerless sash 554, tip 514 is centered within desiccant groove 552. Further, the exposed length of tip 514 controls the depth to which desiccant material is applied into desiccant groove 552. Three-sided applicator nozzle 510 is then moved relative to spacerless sash 554 parallel to desiccant groove 552 so that desiccant material is dispensed into desiccant groove 552 covering the bottom 560 and sides 562 of desiccant groove 552 to a desired thickness.

In a related embodiment, the various glazing systems described above can also be used to form window and doorframes with integrated grill or colonial-type decorations sandwiched between the glass panes to give the appearance of simulated mullion and individual glass panes. Referring now to FIGS. 39, 40A–40B and FIGS. 41A–41B, there is illustrated a simulated mullion window assembly 600 made using one of the various glazing systems described herein and using a notching system 650. In this example embodiment, window assembly 600 is comprised of a window sash 602 (comprised of rails 602A and styles 602B) with a pane support flange 604 that has formed there in a plurality of notches 606. A mullion structure or grille frame 608 with grille clips 609 is insertable into notches 606, to provide the appearance of a multiple pane window, before glass panes 610 and 620 are adhered to window sash 602 and sandwich mullion frame 608 therebetween.

Referring more particularly to the series of figures of FIGS. 40 and 41, in notching window sash 602, window sash 602 is placed in notching system 650 that includes, in this example embodiment, a frame 652 and a lower support 654 that support and secure the window sash during the notching operation. An overhead gantry-type beam 656 supports a notching assembly 660 that can be oriented to form the series of notches 606. A PLC-based controller 658, with associated screen 659 and input buttons, is preferably mounted on frame 652 and is provided to program the number of notches to be formed on the window frame, depending upon the orientation and style of the window frame to be notched. The controller is not necessarily limited to this operation and can be programmed to perform other operations to facilitate window manufacturing.

In an example embodiment of notching assembly 660, a manual notching assembly 661 is illustrated that is easily modified to be mountable on beam 656. In operation, manual notching assembly 661 uses a notcher tooth 662 to punch flange 604 of the window (or door) sash frame through a notcher die 664 to cut-out a space for grille clip 609 to rest. The location of the grille clip maintains the position of the grille frame 608 (or bar if it is just one piece) for the desired grille pattern. Notcher tooth 662 is forced through flange 604 with an air cylinder 666 and is guided therethrough by a pivot arm 668, which is supported by a bracket 670 and a base plate 672, as well as by notcher die 664. A sliding plate 674 maintains the desired distance of notcher tooth 662 off of the table when using the manual tool and off frame 652 when used with the automatic notching assembly equipment. The desired distance is also a function of the window profile. A handle 676 is used to hold notcher 661 in position and to lift and operate the unit. A template guide 678 is used to guide off a template for grille locations in standard sized windows.

Figure 42:
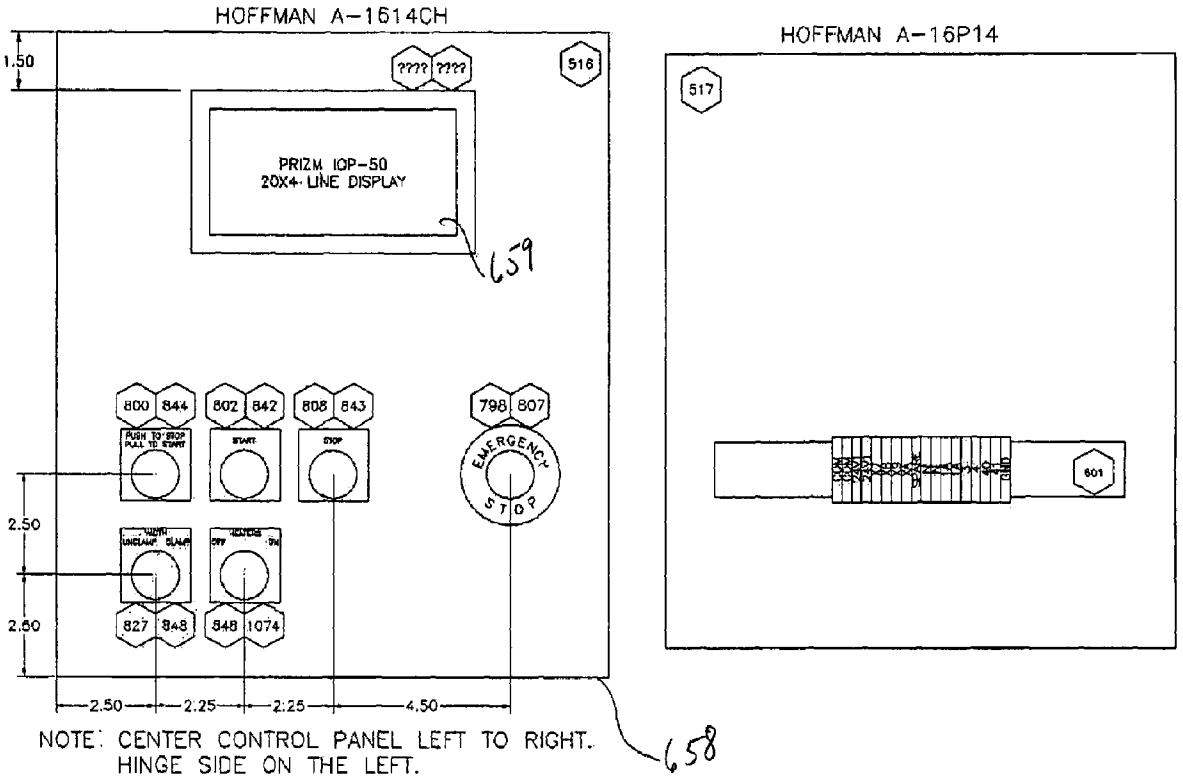
FIG. 42 is a diagram of a controller that forms part of the notching assembly illustrated in FIG. 40.

Referring back to FIGS. 40A and 40B and to FIG. 42, the automatic notching assembly 650 operates on the same basic notching principles with only a few modifications of the handheld notcher for mounting on beam 656. In effecting automatic notching of a window frame in this example embodiment, the following operation is repeated four times to notch both rails (sides) 602A of the window and notch both styles (top and bottom) 602B. Window frame 602 is placed on frame 652 and lower support 654 after which controller 658 activates an auto-sizing feature for determining the size of the window and proceeds to clamp the frame. After programming via use of controller 658, controller 658 determines whether a rail (side) or a style (top/bottom) is being notched and divides the rail/style into the programmed number of grille locations. Controller 658 then initializes notching via notching assembly 660. After the notching operation, the corners of the window frame are hot melted and overweld flashing is removed. The window is then automatically unclamped and the operator rotates the window frame 180 degrees in order to notch the corresponding opposite side of the window frame. Hence, both rails are notched first and then both styles are notched. In this example embodiment, an ionizing vacuum system, as described in connection with FIGS. 31–32, is located adjacent the notching assembly so as pick up the particulate matter before its inadvertently sealed between panes 610 and 620.

Referring more specifically to FIG. 42 and actual operation of controller 658, display 659 advises the operator to remove the window sash from notching assembly 650 and reset it. Once the clamp is cleared of any parts, the operator presses the RESET function key on the display, and then presses the 'Start' PB (power button). The clamp will move first, both sides traveling to the outside edge of the machine (opposite directions), then the notching head will begin moving to left side as the operator is facing assembly 650. When a home switch is made the notch head will move to the center and stop, and the clamps will move to the almost center and stop. The operator will need to press the AUTO function key on the controller. At this time the operator chooses whether the overweld or corner clean operation is needed by pressing the CCLEAN function key on the display. In addition, the RAILS and STILES numbers need to be entered in the controller. The operator presses the ENTER key on the controller and enters the Rail number X, presses ENTER key again, enters the Stile number X, presses the ENTER key another time. The rail and stile information provide the number of notches punched on each side of the window frame.

The operator then loads the window on the clamp assembly and presses the 'Start' PB. The clamps size and clamp the window, the corner clean activates (if selected), and the notching head moves to the required positions and notches the window frame. The notching head moves to center, the clamps unclamp, and then the operator removes the window. This embodiment of the process is repeated 4 times to complete one part (all four sides). First two times are the rail sides, the last two times are the stile sides. After the window is complete it can be set on the lower frame support 654 and cleaned with the vacuum/ionizer wand.

The various embodiments described herein may be embodied in other specific forms without departing from the spirit of the essential attributes thereof. Therefore, the illustrated embodiments should be considered in all respects as illustrative and not restrictive, reference being made to the appended claims rather than to the foregoing description to indicate the scope of the invention.

What is claimed is:

1. A glazing apparatus comprising:

a substantially vertical fixture to support an article to be treated with a viscous material;

a nozzle;

a drive system movably supported by the fixture and adapted to drive the nozzle coupled thereto along a path proximate the article;

a metering device to create a flow of viscous material through the nozzle; and a controller adapted to control the drive system and control the rate of flow of viscous material from the nozzle, wherein the rate of flow of viscous material from the nozzle is proportional to a distance that the nozzle travels proximate the article.

2. The apparatus as claimed in claim 1, wherein the drive system is manually controlled.

3. The apparatus as claimed in claim 1, wherein the drive system is computer controlled.

4. The apparatus as claimed in claim 1, wherein the drive system is adapted to move the nozzle in three axes with respect to the article to be treated.

5. The apparatus as claimed in claim 1, wherein the drive system comprises a gantry operably supporting the nozzle and controlled by the controller.

6. A glazing apparatus applying glazing material to an article to be glazed comprising:

substantially vertical means for supporting the article to be glazed;

means for dispensing the glazing material;

means for driving the dispensing means along a path proximate the article to be glazed;

means for creating a flow of glazing material through the dispensing means; and means for controlling the driving means and the means for creating a flow of glazing material so that the flow of glazing material from the dispensing means is proportional to a distance the nozzle travels proximate the article.

7. The apparatus as claimed in claim 6, wherein the driving means is manually controlled.

8. The apparatus as claimed in claim 6, wherein the driving means is computer controlled.

9. The apparatus as claimed in claim 6, wherein the driving means moves the nozzle in three axes with respect to the article.

10. The apparatus as claimed in claim 6, wherein the driving means comprises a gantry operably supporting the nozzle and controlled by controller means.

11. A glazing apparatus comprising:

a substantially vertical fixture to support a sash member to be treated with a viscous material;

at least one nozzle and metering device assembly comprising a nozzle operably coupled to a metering device and adapted to create a flow of viscous material through the nozzle;

at least one drive system movably supported by the fixture and adapted to drive the nozzle along a flange on the sash member such that the nozzle dispenses the viscous material on the flange; and a controller adapted to control the drive system and control the rate of flow of viscous material from the nozzle, wherein the rate of flow of viscous material from the nozzle is proportional to a distance that the nozzle travels proximate the sash member.

12. The glazing apparatus of claim 11, further comprising a control handle coupled to the drive system adapted to facilitate movement about the sash member by an operator.

13. The glazing apparatus of claim 11, further comprising a plurality of nozzle-metering assemblies with corresponding drive systems adapted to simultaneously dispense the viscous material along two sides of the sash member.

14. The glazing apparatus of claim 13, wherein the viscous material is selected from the group consisting of a desiccant, an adhesive and a hot adhesive.

* * * * *